US012644263B2

(12) United States Patent
Vinzia

(10) Patent No.: US 12,644,263 B2
(45) Date of Patent: Jun. 2, 2026

(54) DEVICE FOR CLOSING AND OPENING BY MANUAL PRESSURE A DRAIN OF A SANITARY FIXTURE

(71) Applicant: Vinzia Fratelli S.p.A., Briga Novarese (IT)

(72) Inventor: Duilio Vinzia, Briga Novarese (IT)

( * ) Notice: Subject to any disclaimer, the term of this patent is extended or adjusted under 35 U.S.C. 154(b) by 218 days.

(21) Appl. No.: 18/669,987

(22) Filed: May 21, 2024

(65) Prior Publication Data

US 2024/0392548 A1 Nov. 28, 2024

(30) Foreign Application Priority Data

May 23, 2023 (IT) ..... 102023000010404

(51) Int. Cl.
*E03C 1/23* (2006.01)

(52) U.S. Cl.
CPC ..... *E03C 1/2306* (2013.01)

(58) Field of Classification Search
CPC ..... E03C 1/23–2308; E03C 2001/2311–2317
See application file for complete search history.

(56) References Cited

U.S. PATENT DOCUMENTS 3,220,695 A * 11/1965 Jones ..... E03C 1/23 4/689
8,214,942 B2 * 7/2012 Yang ..... E03C 1/262 4/690
10,053,844 B2 * 8/2018 Huang ..... E03C 1/2306
2010/0024108 A1 2/2010 Yang

FOREIGN PATENT DOCUMENTS

| | | | | |
|---|---|---|---|---|
| EP | 1338707 | * | 8/2003 | ..... E03C 1/2306 |
| EP | 3202989 | | 8/2017 | |
| IT | 201900003369 | | 9/2020 | |
| KR | 101406261 | | 6/2014 | |

OTHER PUBLICATIONS

Italian Patent and Trademark Office, Search Report, Nov. 30, 2023—Relevant portions are in English.

* cited by examiner

*Primary Examiner* — David P Angwin
*Assistant Examiner* — Nicholas A Ros
(74) *Attorney, Agent, or Firm* — Themis Law

(57) ABSTRACT

A device for closing and opening by manual pressure a drain of a sanitary fixture includes a tubular housing body configured to be associated to a closing plug, and a shank at least partially housed inside the housing body, the shank being configured to be connected to a drain outlet adapted to be occluded by the closing plug. The device further includes a drive spring, an annular rotor that is rotatable and is designed to define at least one first shaped lower surface configured to cooperate with a plurality of ribs provided on the housing body, a plurality of sliding seats of the ribs, and at least one second shaped lower surface configured to cooperate with a striking surface defined on a surface of the shank.

15 Claims, 21 Drawing Sheets

DEVICE FOR CLOSING AND OPENING BY MANUAL PRESSURE A DRAIN OF A SANITARY FIXTURE

FIELD OF THE INVENTION

The present invention refers to a device for closing and opening by manual pressure a drain of a sanitary fixture such as a basin, washbasin, sink, bidet, bathtub, shower or the like.

BACKGROUND OF THE INVENTION

In the sanitary fixture sector, it is known to use closing plugs for drain holes, hereinafter for brevity sometime shortened as "drains", of a sanitary fixture. Such closing plugs generally comprise a movable plug, typically designed like a mushroom, which couples to a fixed outlet, inserted or otherwise connected to a drain hole provided in the sanitary fixture. The mushroom plug is coupled to the fixed outlet by means of a closing and opening device that guides its ascent and descent between a raised or open position, in which the plug does not hinder the outflow of water through the drain, and a lowered or closed position, in which the plug occludes the drain.

The known devices for closing and opening drains of sanitary fixtures typically comprise lever mechanisms and/or returns for their operation that act on the plug to move it between the open position and the closed position and vice versa. However, the lever mechanisms have the disadvantage of requiring adequate calibration and adjustment. In addition, due to corrosion, encrustations and mechanical plays of the various components, the correct operation of the plug is not guaranteed in the long term. On the contrary, over time the lever mechanisms tend to get stiff, being not easy to drive. Last but not least, lever mechanisms often appear bulky and unsightly, generally presenting components protruding from the sanitary fixture in exposed areas.

Other known devices for closing and opening drains of sanitary fixtures comprise snap mechanisms that allow the plug to be pressed downwards to close the drain hole and to be pressed again, always downwards, to allow a reopening of the drain hole and, according to the specific embodiment, are able to offer the user different feelings of use and, specifically:

- a feeling of continuous friction and a small click;
- a noisy click at the end of the travel similar to a retractable pen; or
- a feeling of total absence of obstacles/friction both during closing and opening.

These plugs operated by devices that avoid the use of lever mechanisms and/or returns are known as pop-up plugs.

Document EP 3202989 describes a device for opening/closing a plug for sanitary fixtures that requires a reduced driving force allowing the use of a less rigid drive spring than known devices.

The device comprises a drive member associable with a closing plug, a shank connected or connectable to a drain outlet, a drive spring adapted to urge said drive member and a rotatable rotor comprising thrust elements with an upper profile and a lower profile, the drive member being provided with upper strikers interacting with said upper profile and lower strikers and recesses interacting with the lower profile of the thrust elements of the rotor.

Although the known devices for closing and opening by pressure (pop-up) drains of sanitary fixtures offer attractive aesthetics and their operation is quite reliable over time, they are not without drawbacks.

In particular, their structure is quite complex, varying greatly from model to model intended for the realization of specific feelings of use. This makes it particularly difficult to convert from one model to another and basically impossible to exploit large-scale effects in the management of the individual components in the procurement step for the production of the closing and opening device. Moreover, even the organization of the production itself cannot benefit from synergies due to common parts between the various models. In fact, in the state of the art, each model has a plurality of components that are all different from the functionally corresponding components of the other models.

SUMMARY OF THE INVENTION

In light of the above, the main task of the present invention is to provide a device for closing and opening by manual pressure a drain of a sanitary fixture that has a simple and versatile structure, easily allowing a conversion between models that offer different feelings of use.

Within the scope of this task, it is the object of the present invention to devise a device for closing and opening by manual pressure a drain of a sanitary fixture in which at least one set of components can be used in a multiplicity of different models, thus making it possible to simplify production, easily allow a conversion from one model to another, as well as exploit large-scale effects in the management of the components.

Another object of the present invention is to achieve the objectives set out above in the context of a simple, rational construction solution with high and lasting reliability of use.

The above task, as well as the objects of the present invention are achieved by a device for closing and opening a drain of a sanitary fixture according to the attached claim 1.

The Applicant has advantageously studied and identified a specific combination of characteristics relating to a subset of components that make up the closing and opening device that allow, on the whole, to interact with different components in order to reproduce specific different feelings of use.

Additional characteristics of the preferred embodiments of the device for closing and opening a drain of a sanitary fixture according to the present invention are recited in the dependent claims.

BRIEF DESCRIPTION OF THE DRAWINGS

Additional characteristics and advantages of the present invention will be more evident from the following description of some preferred but not exclusive embodiments thereof made with reference to the appended drawings.

In such drawings,

FIGS. 15*a*-15*l* are partially split perspective views of the closing and opening device of FIG. 12 in the steps of passage from the open to the closed position and vice versa;

FIGS. 19*a*-19*l* are partially split perspective views of the closing and opening device of FIG. 16 in the steps of passage from the open to the closed position and vice versa;

DETAILED DESCRIPTION OF EMBODIMENTS OF THE INVENTION

Figure 1:
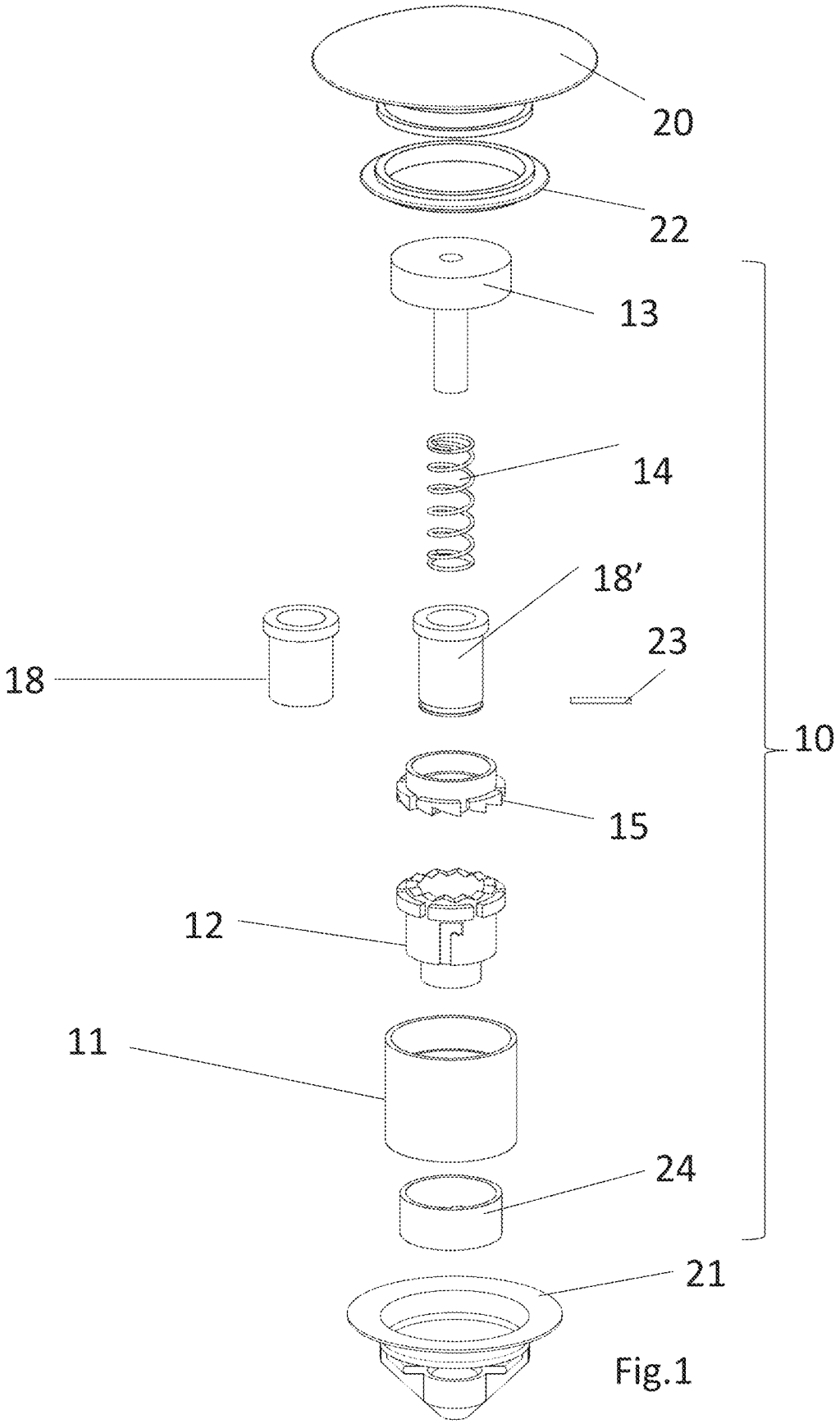
FIG. 1 is an exploded perspective view of the set of components usable in the different models of the closing and opening device according to the present invention in association with a plug and with an outlet of a sanitary fixture.
Figure 2:
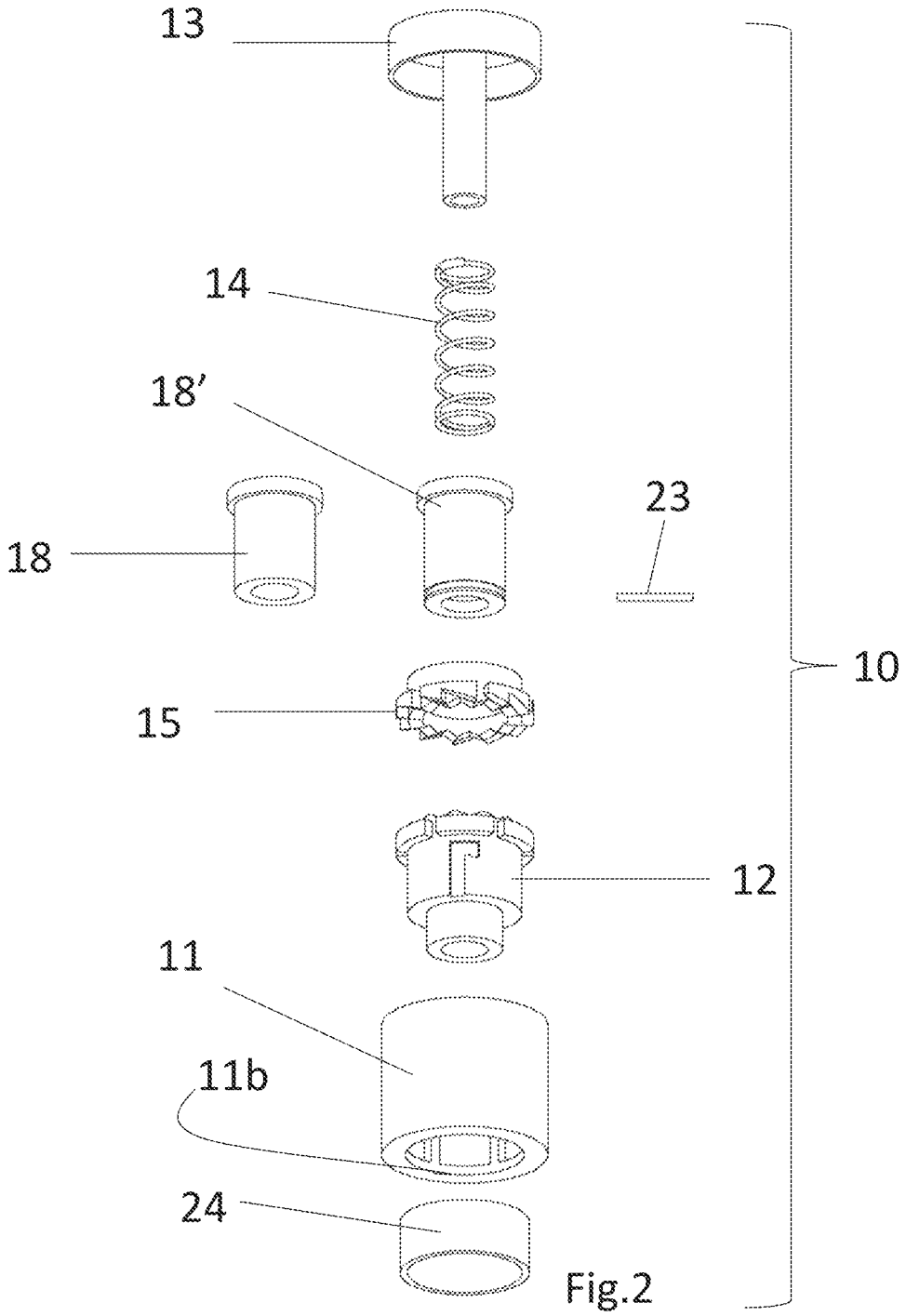
FIG. 2 is an exploded perspective view of the set of components usable in the different models of the closing and opening device according to the present invention.
Figure 3:
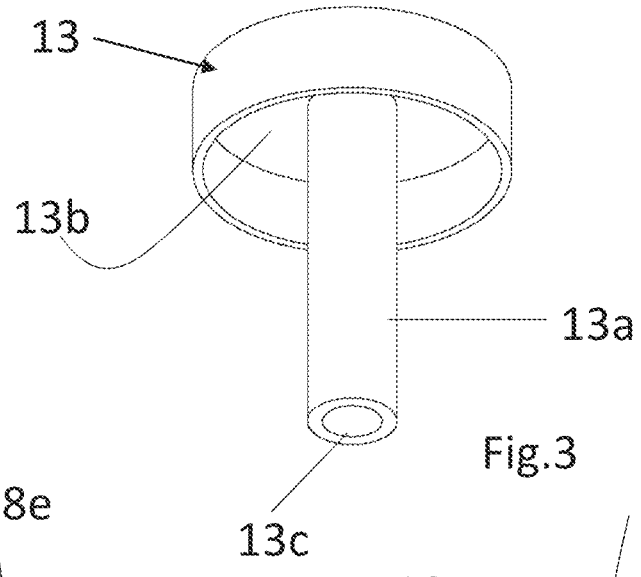
FIG. 3 is a perspective view of the cover used in a closing and opening device according to the present invention.

To illustrate the drawings, use is made of identical numerals or symbols in the following description to indicate construction elements with the same function. Moreover, for clarity of illustration, certain references may not be repeated in all drawings.

While the invention is susceptible to various modifications and alternative constructions, certain preferred embodiments are shown in the drawings and are described hereinbelow in detail. It must in any case be understood that there is no intention to limit the invention to the specific embodiment illustrated, but, on the contrary, the invention intends covering all the modifications, alternative and equivalent constructions that fall within the scope of the invention as defined in the claims.

The use of "for example", "etc.", "or" indicates non-exclusive alternatives without limitation, unless otherwise indicated. The use of "comprises" and "includes" means "comprises or includes, but not limited to", unless otherwise indicated.

With reference to the attached figures, a device for opening and closing by manual pressure a sanitary drain according to a first preferred embodiment of the present invention is described, and is indicated overall with 10.

The opening and closing device 10 comprises a housing body 11, hereinafter simply 'body 11', integrally associated or associable with a closing plug 20.

The device 10 further comprises a shank 12, preferably housed at least partially internally to the body 11.

The shank 12 is suitable for being fixedly and integrally coupled to an outlet 21, in turn associated or associable with a sanitary fixture, such as a washbasin, sink, shower tray, bathtub or the like, at a drain hole thereof or, for the sake of brevity, a drain. In particular, to allow the filling and emptying of the sanitary fixture, the plug 20, depending on its position, is suitable for occluding access to the drain engaged by the outlet 21, thereby preventing the outflow of water through the drain of the sanitary fixture, or leaving access to the drain free, so as to allow the outflow of water.

The sealed occlusion of the outlet 21 is preferably achieved by the provision of a gasket 22. According to one embodiment, the gasket 22 is associated with the closing plug 20 and is arranged perimetrically to a side wall of the closing plug 20 so as to be able to abut against the outlet 21 and close it hydraulically sealingly.

According to a further alternative embodiment, not illustrated, the gasket 22 is associated coaxially and externally to the body 11.

It should be noted that the device 10 may alternatively be associated with a valve or similar device, preferably, but not exclusively, for sanitary fixtures. Therefore, the concept of closing plug 20 must be considered in a broad sense, meaning a device configured to occlude an opening engaged by the outlet 21. The concept of an outlet must also be considered in a broad sense, meaning any interface between the opening and closing device 10 and the drain hole selectively obstructable by the closing plug 20.

The connection of the body 11 to the closing plug 20 can take place in various ways, for example through a threaded connection, a snap connection, gluing or equivalent solutions. The shank 12 can in turn be associated with the outlet 21 by means of a threaded connection, a snap connection or the like.

The body 11 is movable in translation with respect to the shank 12 along a drive axis A of the opening and closing device 10.

Figure 8:
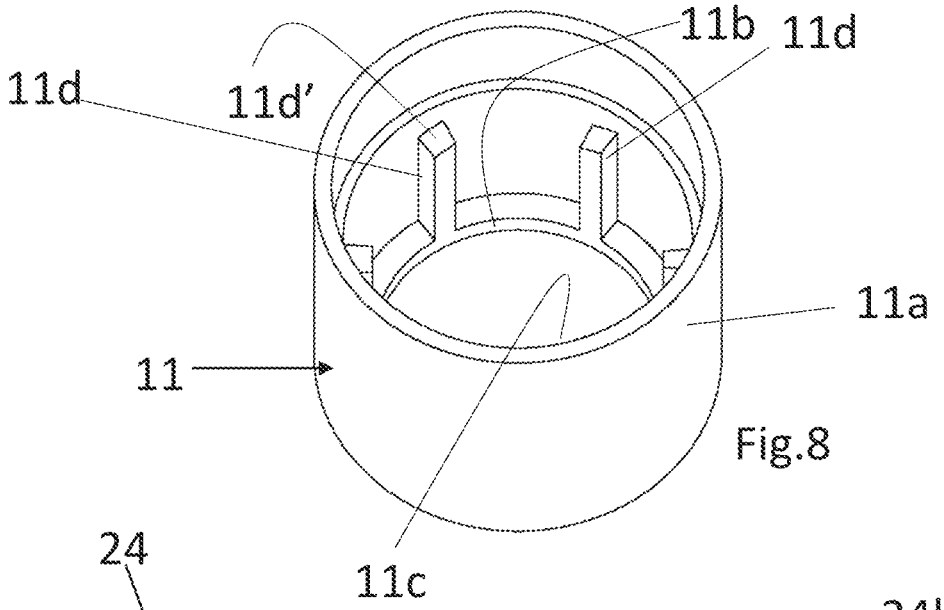
FIG. 8 is a perspective view of a body used in a closing and opening device according to the present invention.
Figure 9A:
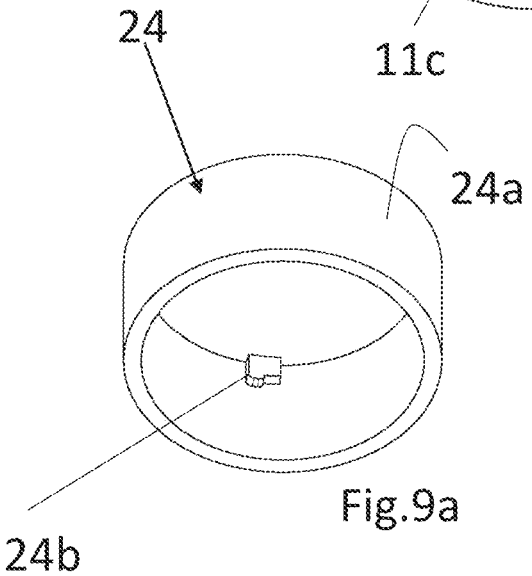
FIGS. 9*a* and 9*b* are perspective views of a bush used to maintain a closing and opening device according to the present invention in a stable open condition.
Figure 9B:
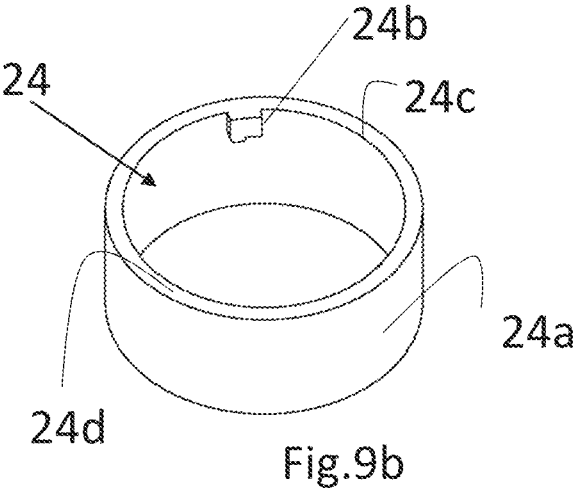
Figure 10:
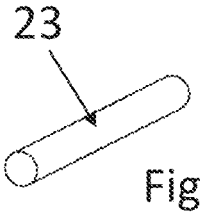
FIG. 10 is a perspective view of a pin used in a closing and opening device according to the present invention.

As illustrated in FIG. 8, the body 11, which, as mentioned, preferably houses in its inside the shank 12, is advantageously hollow for this purpose and has a tubular wall 11*a* delimited at the bottom by a lower opening 11*b* and at the top by an upper opening 11*c*, opposite the lower opening 11*b* with reference to the direction identified by the drive axis A.

Within the scope of the present description and in the following claims, the terms "lower" and "upper" refer to the normal conditions of use of the device 10 when associated with the sanitary fixture.

Advantageously, the shank 12 and the body 11 are coupled to each other in such a way as to be able to make relative translations with respect to each other along the drive axis A, but not to be able to make relative rotations around the axis A.

To this end, in the opening and closing device 10 according to the invention, on an inner surface of the tubular wall 11*a* of the body 11, two or more inwardly protruding ribs 11*d* of the tubular wall 11*a* are made and extend parallel to the drive axis A.

Figure 7A:
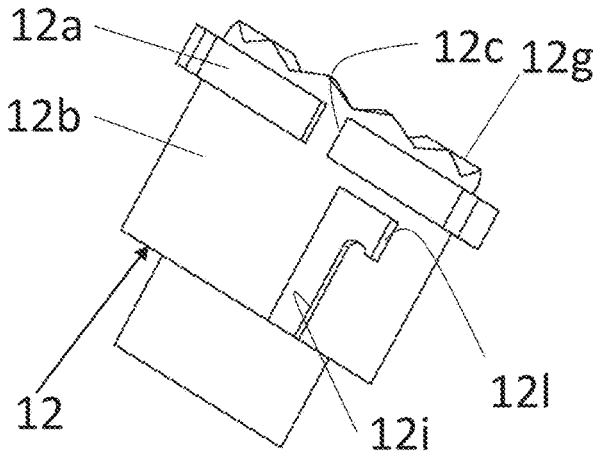
FIGS. 7*a*-7*c* are perspective views of a shank used in a closing and opening device according to the present invention.
Figure 7B:
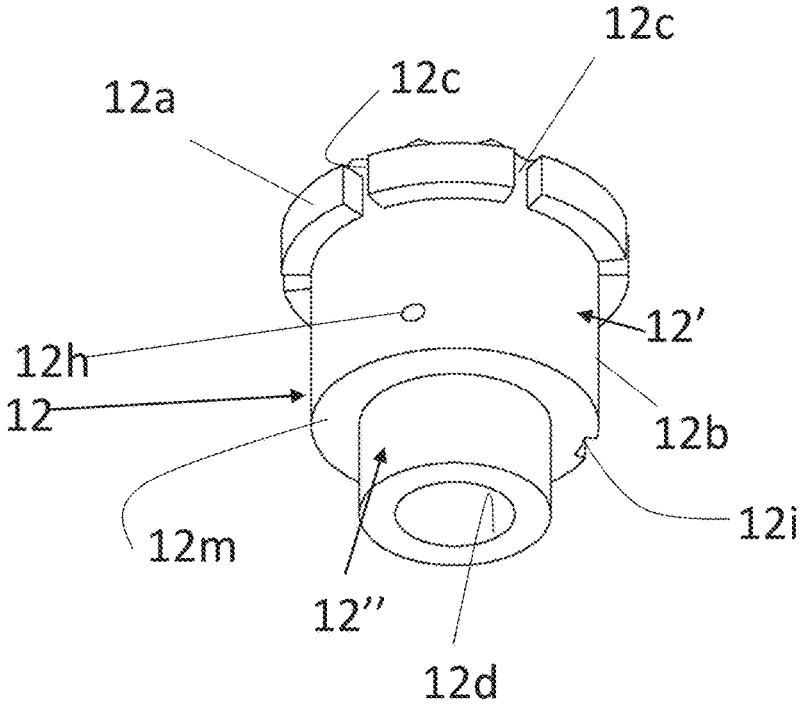
Figure 7C:
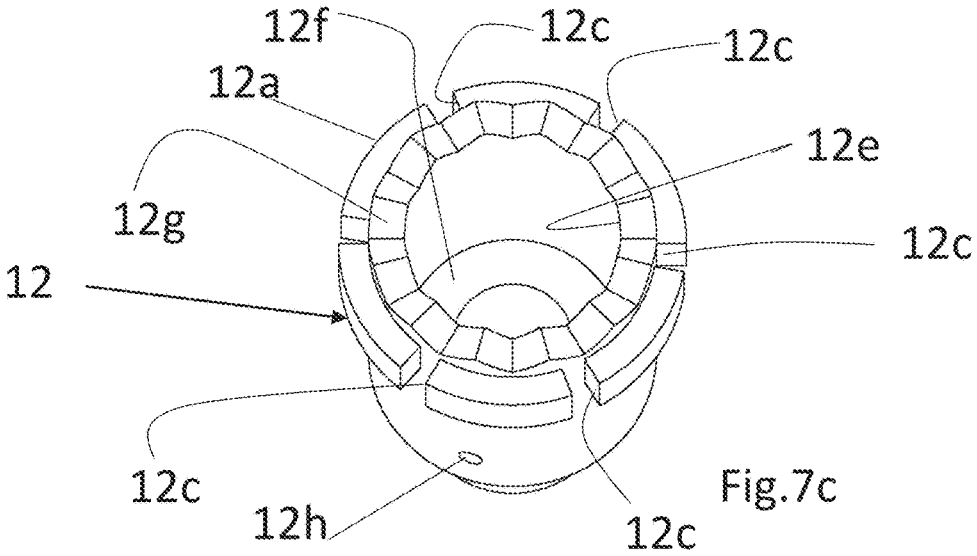

As illustrated in FIGS. 7*a*-7*c*, the shank 12 comprises a crown 12*a* protruding outwardly from an outer surface 12*b* thereof. The crown 12*a* has a plurality of slots 12*c* designed in a complementary manner and arranged in positions corresponding to the rib(s) 11*d*, such that said at least two ribs 11*d* engage at least the two corresponding slots 12*c*.

The number of the slots 12*c* is equal to or greater than the number of the ribs 11*d* present on the body 11.

The device 10 may advantageously comprise a cover 13 associated with the body 11, and designed in such a way as to at least partially close the upper opening 11*c* of the latter and come to rest against the plug 20, configured to be associated with said housing body 11.

In the illustrated embodiments, the cover 13 is integral with the body 11 and, advantageously, forms with it an assembly operable by a user, in particular through an action on the plug 20, for opening and closing the drain, as will be clarified below.

The cover 13 further comprises a central shaft 13*a* that develops along the drive axis A towards the shank 12. In particular, the central shaft 13*a* of the cover 13 is configured to slide inside the shank 12, which for this purpose is advantageously hollow.

In a non-illustrated embodiment the shank 12 comprises a tubular wall defining an outer surface 12*b* and an inner cavity provided with at least one radially protruding element that forms a rest surface for the lower end of the rotor support 18' with reference to the direction identified by the drive axis A.

In the illustrated embodiment the shank 12 comprises a tubular wall with variable diameter defining the outer surface 12*b* and an inner cavity. The inner cavity has a narrowing surrounded by an annular rest surface 12*f*.

The tubular wall of the shank 12 is delimited at the bottom by a lower opening 12*d* and at the top by an upper opening 12*e*, opposite the lower opening 12*d* with reference to the direction identified by the drive axis A. The central shaft 13*a* of the cover is configured to slide along the inner cavity of the shank 12 until substantially reaching the lower opening 12*d*.

In the illustrated embodiments the tubular wall with variable diameter of the shank 12 defines two cylindrical portions 12' and 12" of the shank 12 with different diameter. Said portions, i.e. a first cylindrical portion with a larger diameter 12' and a second cylindrical portion with a smaller diameter 12", have an outer annular surface 12*m* and an inner connecting surface 12*f*; the portion with a larger diameter 12' is provided with the crown 12*a* near said upper opening 12*e* and the portion with a smaller diameter 12" is provided with said lower opening 12*d*.

Said outer annular surface 12*m* rests against protruding inner surfaces 21*a* of the outlet 21, being the shank 12 configured to be connected to the drain outlet 21.

Figure 11:
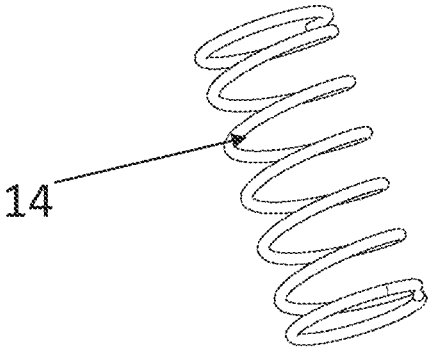
FIG. 11 is a perspective view of a spring used in a closing and opening device according to the present invention.

The device 10 further comprises a drive spring 14 (FIG. 11), such as for example a helical spring, adapted to exert an elastic action parallel to the drive axis A on the assembly consisting of the body 11 and of the cover 13, in particular on the cover 13 and consequently on the body 11 integral with it, in contrast to the gravitational force to keep the body 11 raised with respect to the shank 12. The drive spring 14 develops substantially around the central shaft 13*a* of the cover 13 and rests on the lower surface 13*b* of the cover 13.

The spring 14 and the shaft 13*a* are preferably tubular.

The cover 13 allows to assemble the spring 14, the rotor support 18,18', the annular rotor 15, the shank 12 and the body 11. In addition, the shaft 13*a* guides the spring 14.

The central shaft 13*a* of the tubular-shaped cover 13 with through hole 13*c* also allows to insert an inner pin that connects the plug 20 to any element placed below the shank 12 or the device 10, for example a gasket positioned not on the plug 20 but below the device 10.

As illustrated in the figures, the cover 13 is inserted inside the body 11 with its upper surface 13*d* flush with the upper opening 11*c*.

Said upper surface 13*d* is in abutment against the plug 20, when said plug 20 is associated with the housing body 11.

Figure 26:
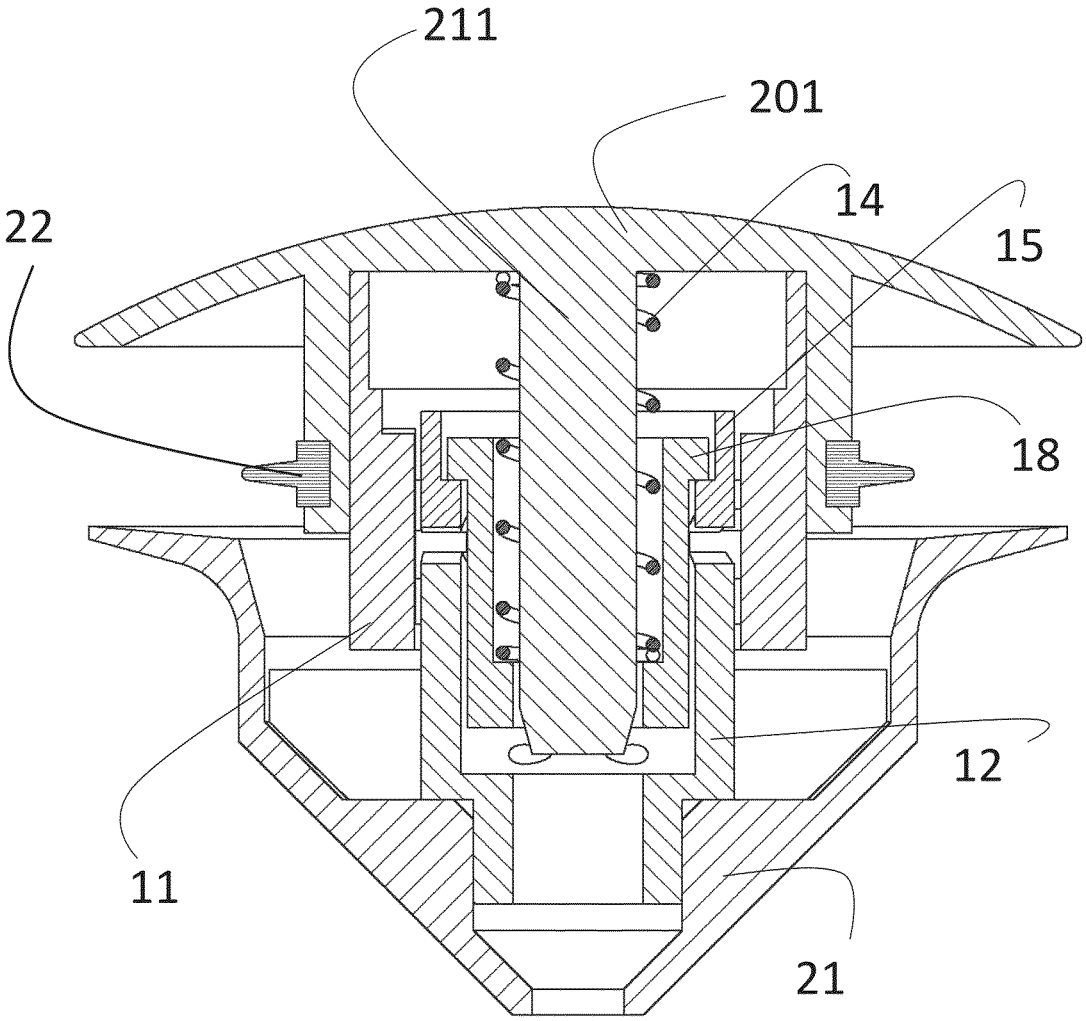
FIG. 26 is a sectional view of a closing and opening device according to the present invention in association with a plug provided with a central shaft and with an outlet of a sanitary fixture, in the open position.

As illustrated in FIG. 26, the cover 13 may be absent in the embodiments subject-matter of the present invention.

In the absence of the cover 13, the plug 201 is in contact and/or made integral with the body 11 and has a central shaft of guide for the spring 14 in a manner similar to the shaft 13*a* of the cover 13. In the embodiment in FIG. 26 the drive spring 14 develops substantially around the central shaft 211 of the plug 201 and rests on the lower surface of the plug 201.

Figure 6A:
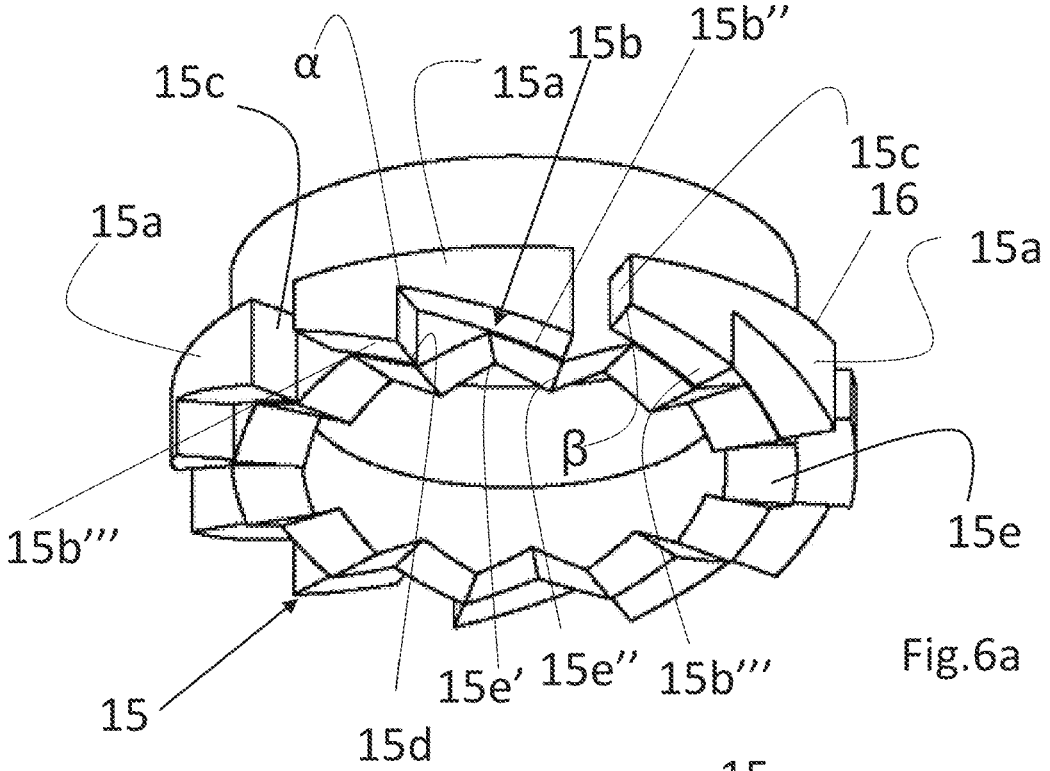
FIGS. 6*a* and 6*b* are perspective views of a rotor used in a closing and opening device according to the present invention.
Figure 6B:
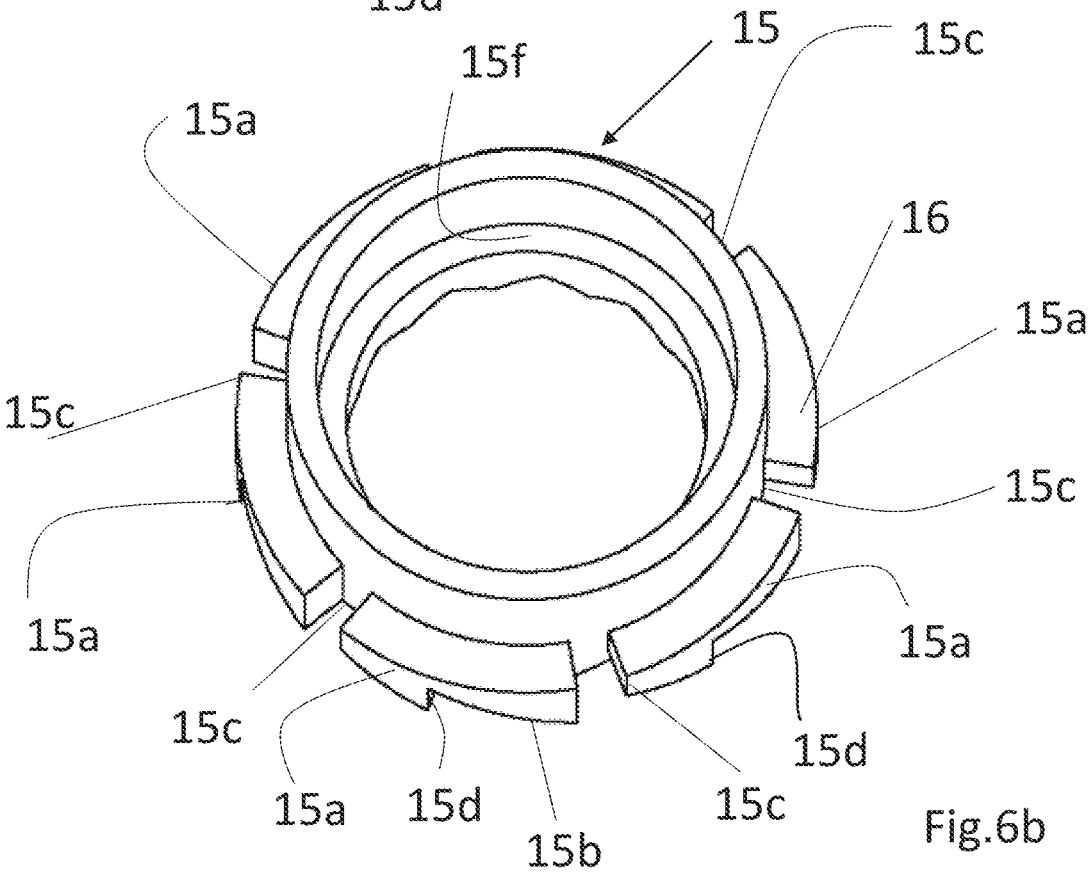

The device 10 also comprises an annular rotor 15 (FIGS. 6*a* and 6*b*) free to rotate around the drive axis A with respect to the shank 12 and the body 11.

The annular rotor 15 is free to translate axially with respect to the shank 12.

On its outer side surface, the annular rotor 15 is provided with thrust elements 15*a* designed in such a way as to define a first shaped lower surface 15*b*, with at least two inclined surface portions 15*b*" and 15*b*'", which is turned downwards or lower one. In particular, the thrust elements 15*a* are arranged on the outer side surface of the annular rotor 15 in such a way as to cooperate with the plurality of ribs 11*d* of the body 11 to selectively prevent or allow a relative translation between the body 11 and the annular rotor 15 under the thrust action exerted by the drive spring 14. To this end, a sliding seat 15*c* is defined between pairs of adjacent thrust elements 15*a*. Within each sliding seat a respective rib 11*d* can slide to allow the body 11 to rise with respect to the shank 12.

As shown in the figures, the thrust elements 15*a* protrude from the outer side surface of the annular rotor 15.

The first shaped surface 15*b* of the thrust elements 15*a* is further designed so as to cooperate with an upper termination of the ribs 11*d* so as to guide a relative rotation movement between the annular rotor 15 and the body 11 up to a position in which the ribs 11*d* are stably in abutment against a stop seat 15*d* made between the two inclined surface portions 15*b*" and 15*b*'" of the first shaped surface 15*b* of each thrust element 15*a*.

The thrust elements 15*a* of the annular rotor 15 have a flat, non-shaped upper surface 16.

The annular rotor 15 has a second shaped lower surface, which is turned downwards, 15*e* designed in such a way as to interact with a striking surface 12*g* which can be selectively brought into contact with said second shaped surface 15*e*, acting in contrast to the action exerted by the drive spring 14.

As shown in the figures, said second shaped lower surface 15*e* is provided with depressions 15*e*' and protrusions 15*e*".

In particular, in the embodiment shown, the second shaped lower surface 15*e* has a zigzag pattern with edges to create depressions of substantially triangular section.

In particular, the striking surface 12*g* has a counter-shaping such as to locally achieve, with the second shaped surface 15*e* of the annular rotor 15, a transfer of tangential forces such as to induce a relative rotation movement between the annular rotor 15 and the body 11.

The striking surface 12*g* is made on the shank 12.

The annular rotor 15 is in axial contact with the body 11 and/or with the shank 12.

The surfaces 11*d*' of contact between the ribs 11*d* and the first shaped lower surface 15*b* of the annular rotor 15 and the striking surface 12*g* intended for contact with the second shaped surface 15*e* of the annular rotor 15 are or comprise portions of helical surfaces that simulate a contact between screw and nut screw.

The surface portions forming the striking surface 12*g* (FIG. 7*c*) of the shank 12, the surface portions forming the first and second shaped lower surface 15*b* and 15*e* of the annular rotor 15 (FIG. 6*a*) have a right and a left pitch, alternating with each other.

The surfaces 11*d*' of the ribs 11*d* and the surfaces 15*b*" and 15*b*'" of the first shaped lower surface 15*b* of the annular rotor 15 are instead inclined in a single direction.

An acute angle a is formed between the vertical surface that delimits the stop seat 15*d* and the surface 15*b*" of the shaped lower surface 15*b*.

An obtuse angle β is formed between the vertical surface that delimits the sliding seat 15*c* and the surface 15*b*'" of the shaped lower surface 15*b*.

The device 10 also comprises a rotor support 18, 18'.

Figure 4A:
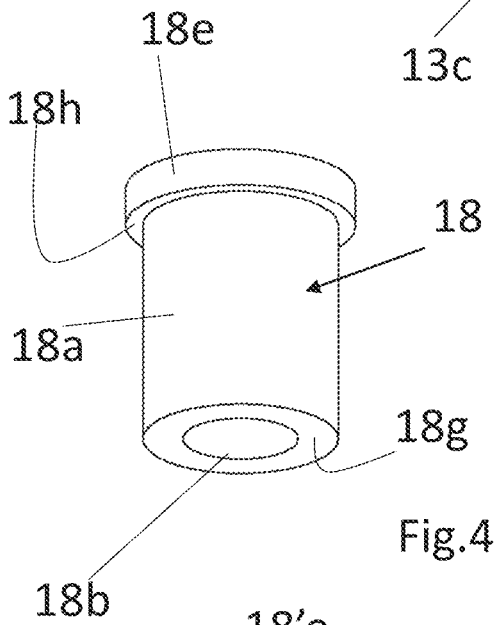
FIGS. 4*a* and 4*b* are perspective views of a rotor support used in a closing and opening device according to the present invention.
Figure 4B:
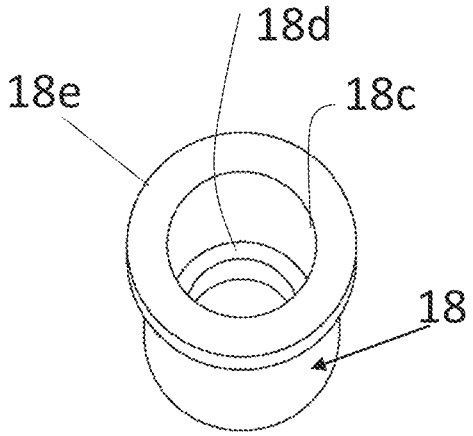
Figure 5A:
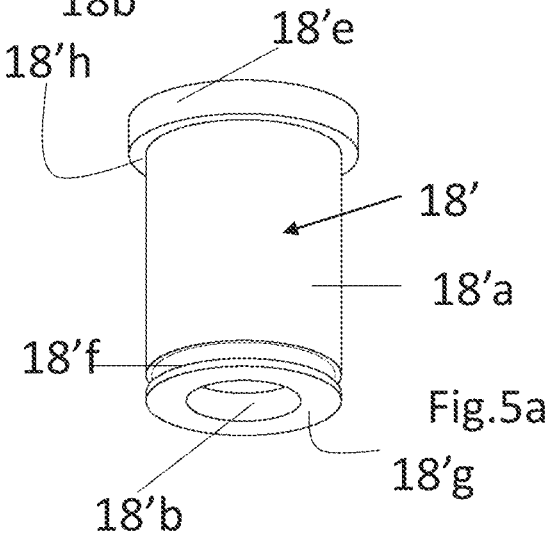
FIGS. 5*a* and 5*b* are perspective views of a rotor support used in a closing and opening device according to the present invention.
Figure 5B:
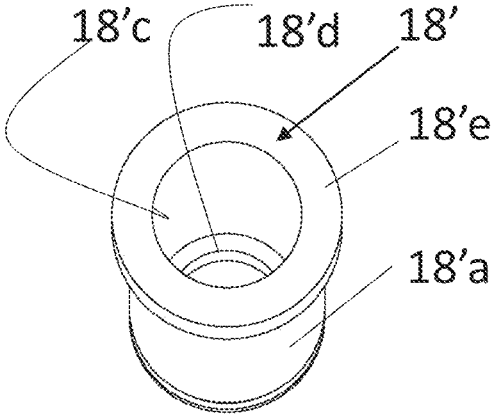

The rotor support 18 is made as a hollow tubular body with a smooth mantle surface i.e. with a smooth outer surface (FIGS. 4*a* and 4*b*) or provided with an annular groove 18'*f* at a lower opening 18'*b* thereof (FIGS. 5*a* and 5*b*).

The rotor support 18,18' is arranged internally and coaxially to said annular rotor 15.

The rotor support 18 is hollow being defined by a tubular wall 18*a* with constant diameter, delimited at the bottom by a lower opening 18*b* and at the top by an upper opening 18*c*, opposite the lower opening 18*b* with reference to the direction identified by the drive axis A. The central shaft 13*a* of the cover 13 (or the central shaft 211 of the plug 201, when said cover 13 is not present) and the drive spring 14 are housed inside the rotor support 18. In particular, the drive spring 14 acts against a lower surface 18*d* of the rotor support 18 that surrounds the lower opening 18*b* and the central shaft 13*a* is sized so as to be able to slide through the lower opening 18*b* of the rotor support 18,18'.

In this way the hollow rotor support 18 acts as a guide of the spring 14.

At the upper opening 18*c* there is provided a collar 18*e* made as one piece with the hollow tubular body.

The annular rotor 15 has a narrowing therein that forms an abutment surface 15*f* for the collar 18*e* of the rotor support 18.

FIGS. 12-15*l* show a first embodiment of the opening and closing device 10 in which the annular rotor 15 is positioned externally to the tubular rotor support 18, as described above, said rotor support 18 housed internally to the shank 12 rests with said collar 18*e*, the annular rotor 15 being provided therein with an element that forms an abutment surface 15*f* for the collar 18*e*, 18'*e* of the rotor support 18 housed internally and coaxially to said rotor 15.

In particular, the lower surface 18*h* of the collar 18*e* is in abutment on the narrowing 15*f* provided internally to the annular rotor 15.

In this embodiment, the rotor support 18 has a longitudinal extension of the tubular wall 18*a* such that it does not, in any operating condition, rest against the at least one radially protruding element inside the shank (embodiment not illustrated) or against the inner rest surface 12*f* of the shank 12.

The rotor support 18 therefore rests on the annular rotor 15.

The tubular rotor support 18 is housed internally to the shank 12 and is itself hollow to house therein the drive spring 14 and the central shaft 13*a* of the cover 13 (or the central shaft 211 of the plug 201, for the embodiment in which the cover 13 is not present). Furthermore, the rotor support 18 has a lower surface 18*d* that surrounds a lower opening 18*b* through which the central shaft 13*a* is free to slide. The lower surface 18*d* otherwise acts as a striker against which the drive spring 14 acts.

The first shaped surface 15*b* is a lower surface of the thrust elements 15*a* provided on its side surface of the annular rotor 15 and the second shaped surface 15*e* is the surface turned downwards, or lower surface or edge, of the annular rotor 15 itself.

With reference to the annular rotor 15, the first 15*b* and the second 15*e* shaped surface are two mutually concentric annular surfaces, with the first shaped surface 15*b* radially outermost with respect to the second shaped surface 15*e*.

The striking surface 12*g* is made at a surface of the shank 12 turned upwards or upper surface.

Figure 12:
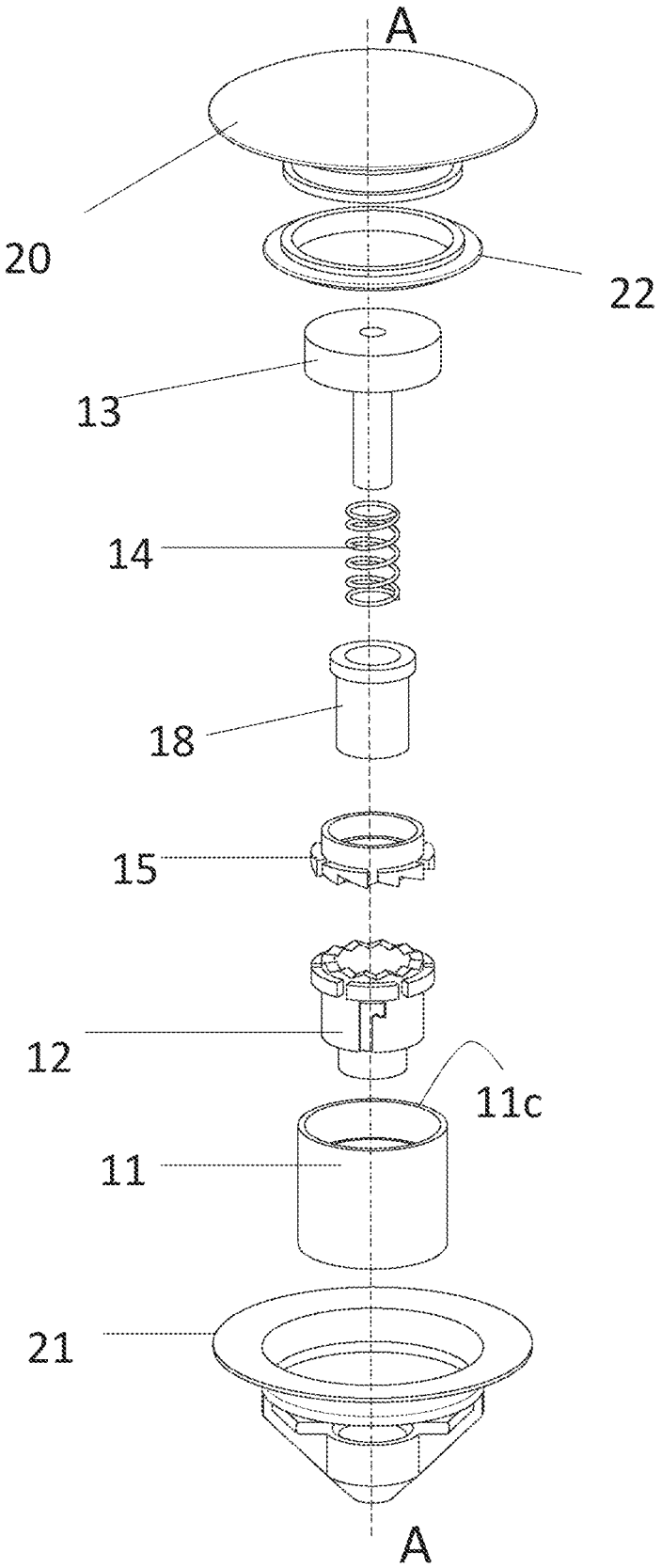
FIG. 12 is an exploded perspective view of a closing and opening device according to the present invention in association with a plug and with an outlet of a sanitary fixture.

As shown in FIG. 12, the rotor support 18 is hollow being defined by a tubular wall 18*a* with constant diameter, delimited at the bottom by a lower opening 18*b* and at the top by an upper opening 18*c*, opposite the lower opening 18*b* with reference to the direction identified by the drive axis A.

Figure 13A:
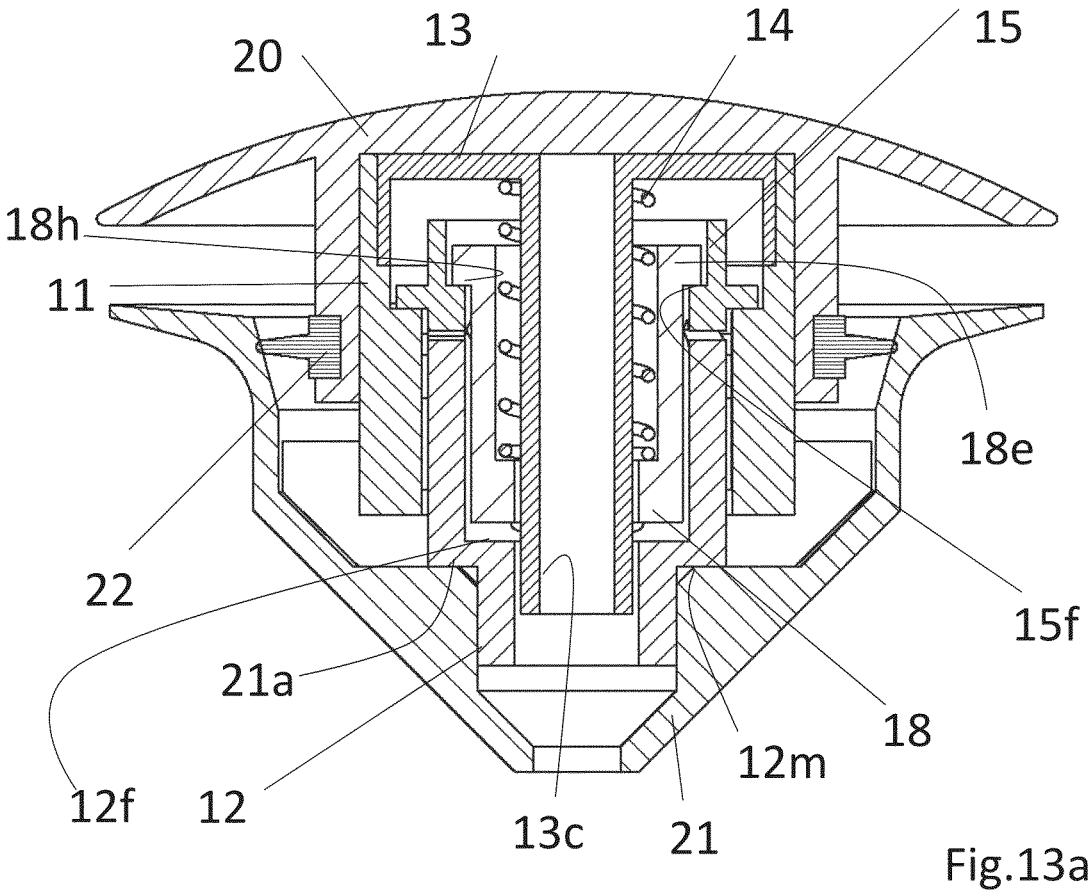
FIGS. 13*a* and 13*b* are sectional views of the closing and opening device of FIG. 12 in association with a plug and with an outlet of a sanitary fixture, respectively in the closed and open position.
Figure 13B:
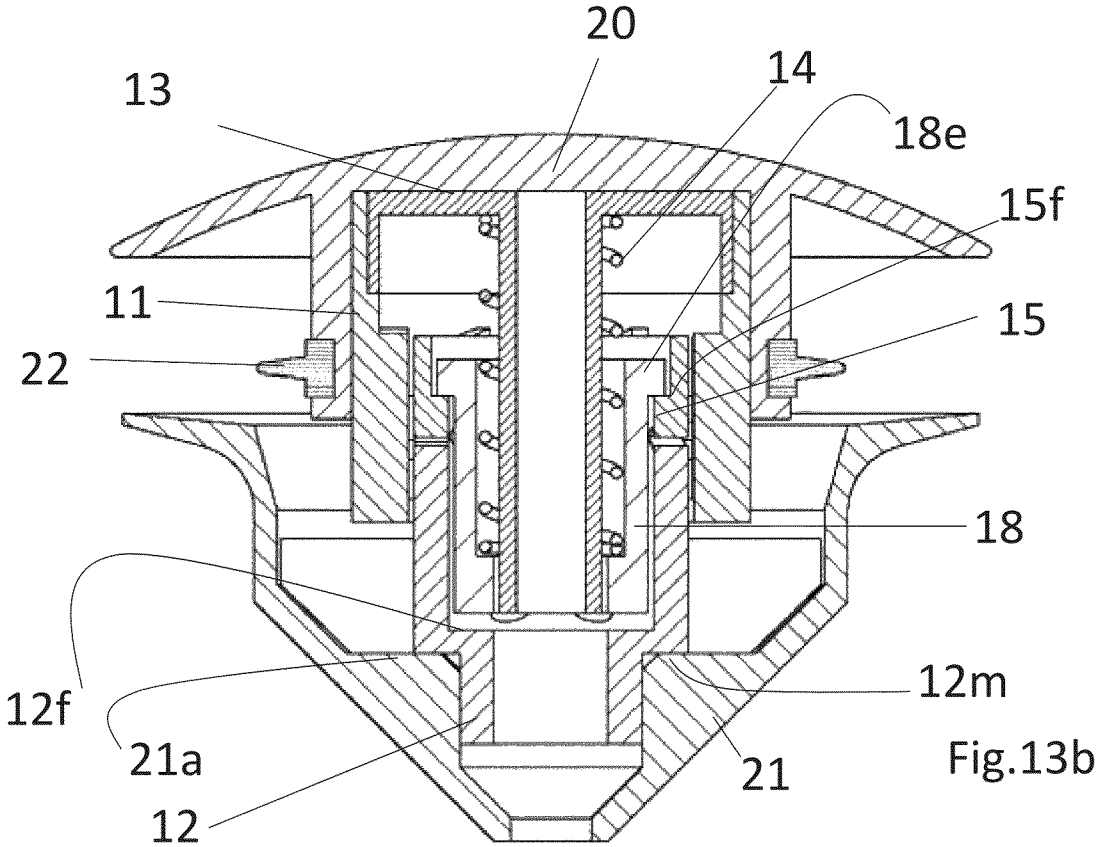

As shown in FIGS. 13*a* and 13*b*, the central shaft 13*a* of the cover 13 and the drive spring 14 are housed inside the rotor support 18.

As described above in the absence of the cover 13, it is possible to provide a plug 201 with central shaft 211, in which the central shaft 211 of the plug 201 and the drive spring 14 are housed inside the rotor support 18.

In particular, the drive spring 14 acts against a lower surface 18*d* of the rotor support 18 that surrounds the lower opening 18*b* and the central shaft 13*a* is sized so as to be able to slide through the lower opening 18*b* of the rotor support 18. In this way the hollow rotor support 18 acts as a guide of the spring 14.

Figure 14A:
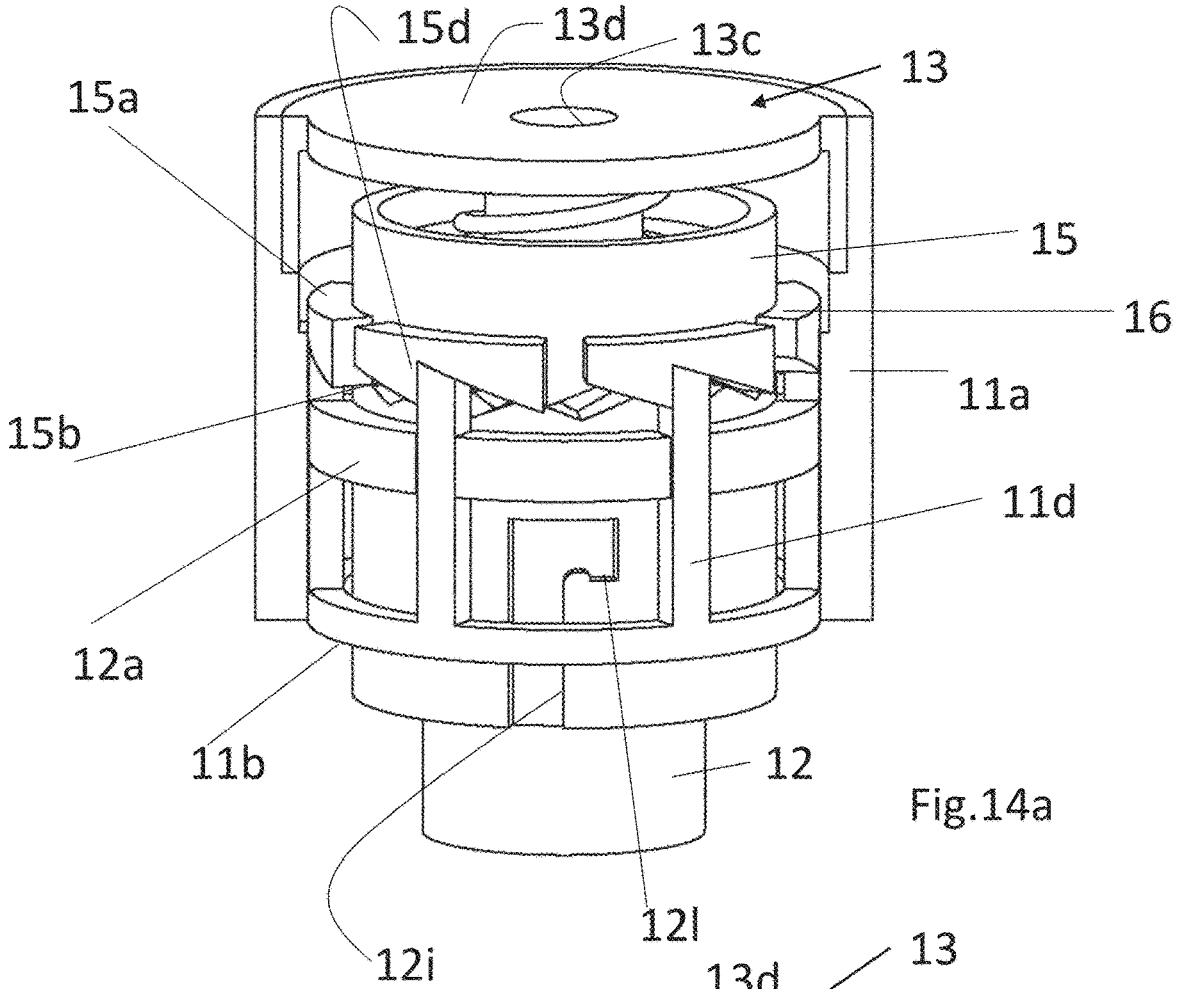
FIGS. 14*a* and 14*b* are partially split perspective views of the closing and opening device of FIG. 12, respectively in the closed and open positions.
Figure 14B:
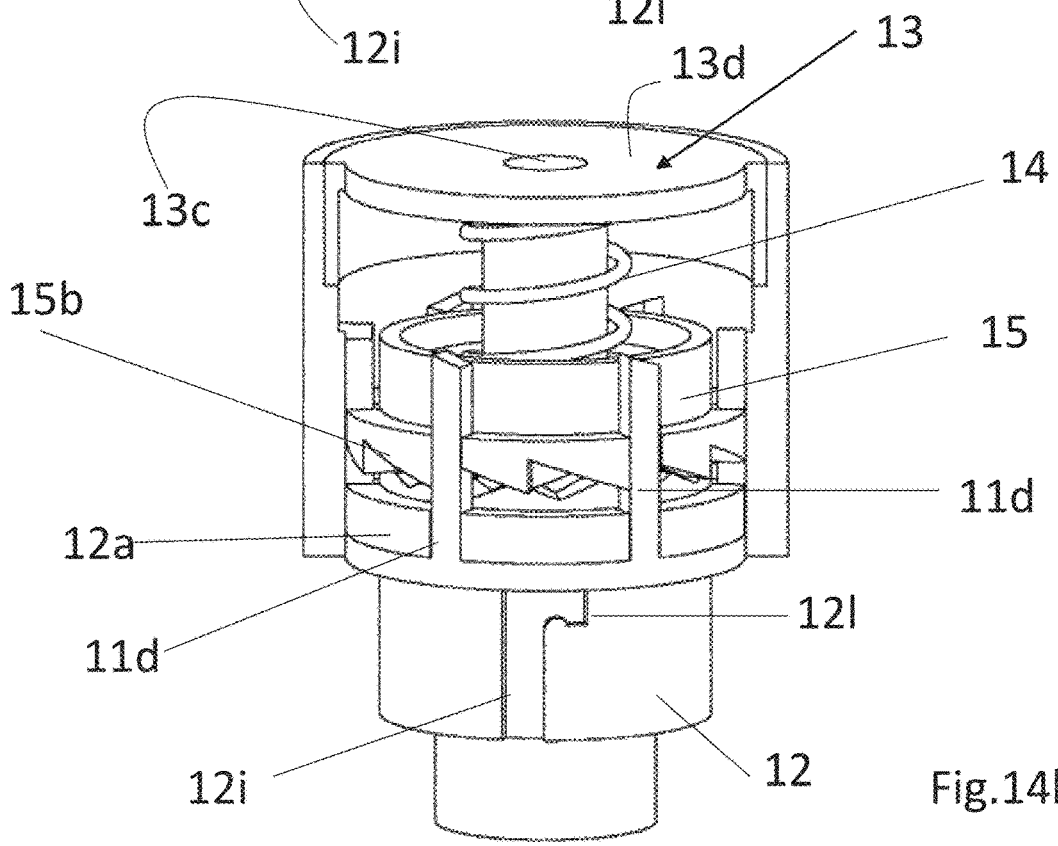

FIGS. 14*a*-14*b* show two positions that the opening and closing device 10 according to the first embodiment can assume: a first balanced position or closed position, and a second balanced position or open position.

FIG. 14*a* shows the closed position of the device 10.

In this position, the ribs 11*d* of the inner wall of the body 11 are in abutment against the first shaped surface 15*b* of the annular rotor 15 and, in particular, are housed in respective stop seats 15*d* defined by said first surface 15*b*.

In this way, the sliding of the body 11 along the axis A under the action of the drive spring 14 is prevented by the striking action that the thrust elements 15*a* exert on the ribs 11*d*. In this closed position, the drive spring 14 cannot therefore push the plug 20 to rise. The plug itself is therefore arranged on the outlet 21 so as to compress the gasket 22 and make a hydraulic seal, as shown in FIG. 13*a*, preventing the outflow of water through the outlet 21 itself.

By acting on the body 11, i.e. by pressing the plug 201 provided with a central shaft 211 or by means of the plug 20 and the cover 13, when the latter is present, with a pressure along the axis A approaching the annular rotor 15 to the shank 12, the second shaped surface 15*e* of the annular rotor 15 comes into engagement with the striking surface 12*g* made on the shank 12.

This causes a relative slipping between the two surfaces 15*e*, 12*g* along the respective shapes that leads to a relative rotation between the annular rotor 15 and the shank 12 and, consequently, also between the rotor 15 and the body 11. In this way the ribs 11*d* are gradually moved away from the respective stop seats 15*d* and brought at the sliding seats 15*c*.

Once the ribs 11*d* engage the sliding seats 15*c*, the body 11 is free to slide under the action of the drive spring 14 and to rise with respect to the shank 12 to reach the open position illustrated in FIGS. 13*b* and 14*b*.

FIGS. 15*a*-15*l* illustrate the different steps with the relative positions of the elements that make up the device 10 in the passage from the open condition of the drain to the closed condition and vice versa.

In the open position (FIG. 15*a*), the drive spring 14 is substantially not compressed (except for the action of compressing the weight of the plug 20 and possibly the residual water column) so as to bring the body 11 and therefore the plug 20 in a condition of maximum distancing from the shank 12 and from the outlet 21, with respect to the drive axis A.

In this condition the gasket 22 is arranged away from the outlet 21 (FIG. 13*b*) so that the outflow of water through the outlet 21 is not hindered.

To pass from the open position to the closed position, the user exerts pressure on the body 11, through the plug 201 with central shaft 211 or through the plug 20 and the cover 13 when the latter is present, by pushing the body 11 towards the shank 12.

Figures 15A, 15B, 15C, 15D, 15E, 15F, 15G, 15H, 15I, 15L:
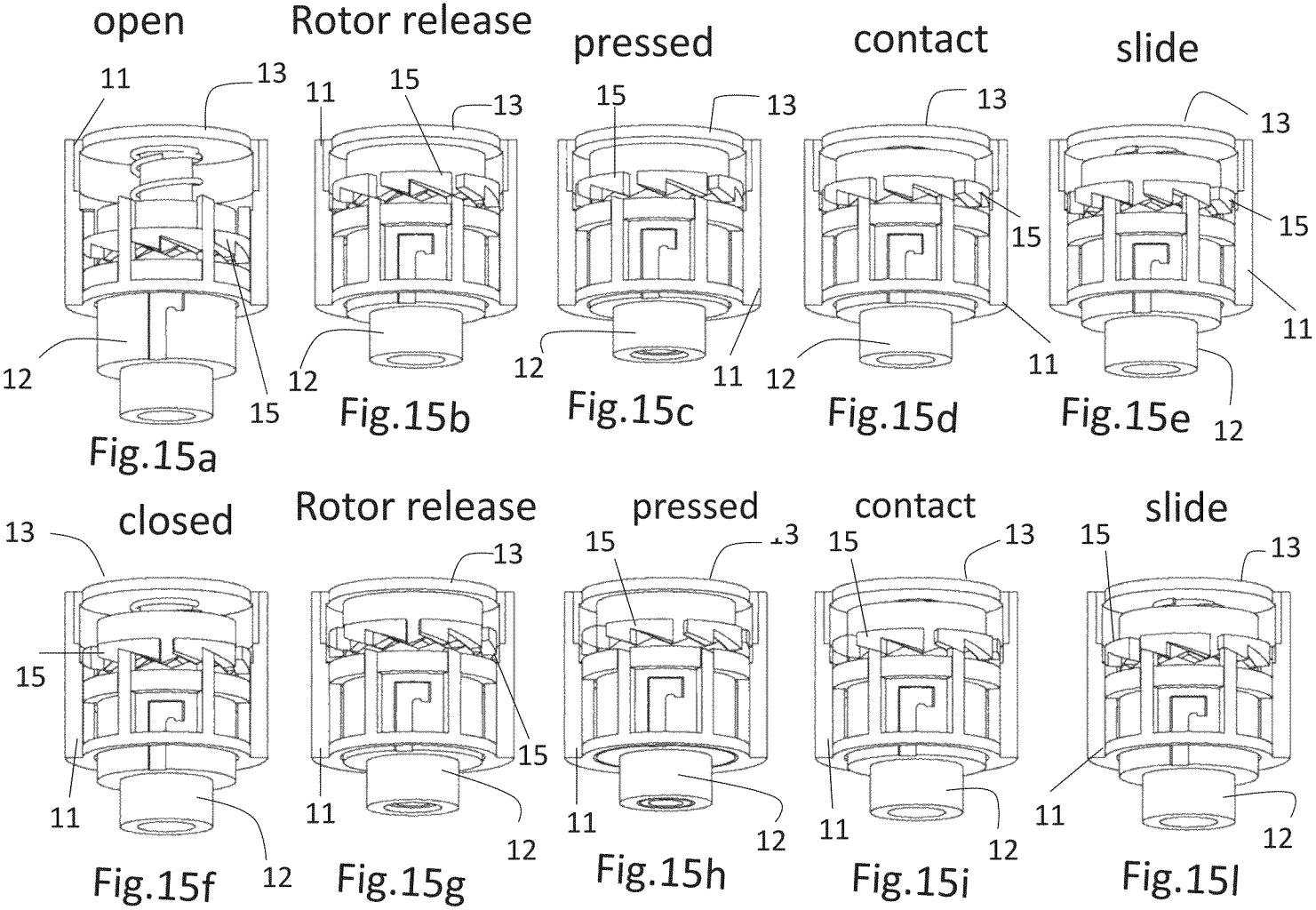
Figure 16:
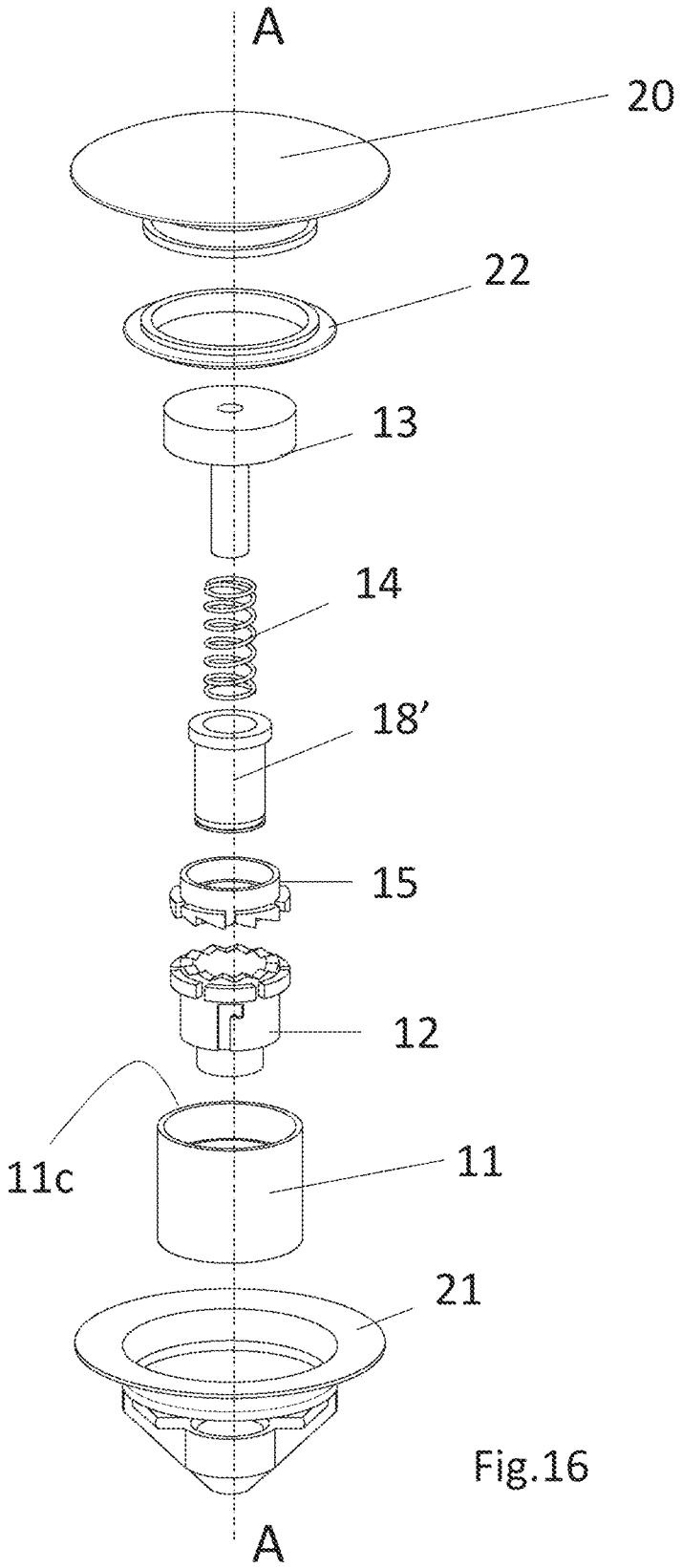
FIG. 16 is an exploded perspective view of another closing and opening device according to the present invention in association with a plug and with an outlet of a sanitary fixture.

The ribs 11*d* slide (FIG. 15*b*) in this way inside the sliding seats 15*c* of the annular rotor 15 until they free them (FIG. 15*c*).

The ribs come into contact and slide (FIGS. 15*d* and 15*e*) on the inclined surface 15*b*" of the thrust elements 15*a* of the annular rotor 15: the translation of the body 11 towards the shank 12 causes the engagement between the second shaped surface 15*e* and the striking surface 12*g* (intermediate engagement position or position of maximum momentary insertion of the shank 12 into the housing body 11) which causes a relative rotation between the rotor 15 and the shank 12 until the ribs 11*d* engage with the first shaped surface 15*b* made below the thrust elements 15*a* of the annular rotor 15.

By effect of the drive spring 14, this engagement causes a relative rotation between the annular rotor 15 and the body 11 until the ribs 11*d*, by sliding along the inclined portion 15*b*" of the first shaped surface 15*b*, reach the respective stop seat 15*d* and the opening and closing device 10 reaches its closed position (FIG. 15*f*).

It should also be noted that in the closed position illustrated in FIGS. 13*a* and 14*a*, it is possible to open the plug 20 simply by lifting it. This action involves raising the body 11 which carries the annular rotor 15 with it, as the rotor support 18 can slide with respect to the shank 12. By releasing the plug 20, it falls back, getting closed, by effect its weight. Such additional functionality advantageously allows the plug 20 to be opened manually in addition to the mode described herein.

In essence, through the opening and closing device 10 according to the first embodiment it is possible to realize a snap closure with gravitational seal: the seal is substantially guaranteed by the force of gravity and, in order to reduce friction between the components, the annular rotor 15, has two shaped lower surfaces, one 15*b* only in contact with the body 11 and the other 15*e* (the innermost) in contact only with the shank 12.

Thus by pressing the plug 20 or the plug 201 (i.e. the body 11), the ribs 11*d* come out of the slots 15*c*, allowing the rotation of the annular rotor 15.

The spring 14 transmits its force through the rotor support 18 on the rotor 15, the annular rotor 15 is obliged to rotate following the striking surface 12*g* of the shank 12.

As illustrated in the figures, the striking surface 12*g* shows a zigzag profile with peaks and grooves: the "descending" surface portions therefore facilitate a relative rotation between the annular rotor 15 and the shank 12.

FIGS. 15*g* to 15*l* illustrate the steps leading to the opening of the drain: by exerting a pressure on the body 11 through the plug 201 (or the plug 20 and the cover 13, when present), the ribs disengage from the seats 15*d* of the annular rotor 15, the engagement between the second shaped surface 15*e* and the striking surface 12*g* is created (FIGS. 15*h* and 15*i*, position of maximum momentary insertion of the shank 12 into the housing body 11) and the upper termination of the ribs 11*d* slips on the inclined surface 15*b*'" of the thrust elements 15*a* provided on its side surface of the annular rotor 15 (FIG. 15*l*) until the ribs engage sliding seats 15*c* of the annular rotor 15 (FIG. 15*a*).

The engagement between the surface 12*g* of the shank and the second surface 15*e* of the annular rotor 15 is shown in FIGS. 15*c*, 15*d* and 15*h* and 15*i*, that happens in the position of maximum momentary insertion of the shank 12 into the housing body 11.

In FIGS. 16-19*l*, a second embodiment of the opening and closing device 10 is shown in which the annular rotor 15 is mounted between the shank 12 and the rotor support 18'.

In this embodiment the rotor support 18' has a longitudinal extension of the tubular wall 18'*a* such that its lower end or base 18'*g*, opposite the crown 18'*e* rests against the inner rest surface 12*f* of the shank 12 (FIGS. 17*a* and 17*b*), for the embodiment with shank 12 with tubular wall with variable diameter, or against said at least one radially protruding element inside the cavity of the shank 12 for the embodiment, not illustrated with shank 12 with tubular wall with constant diameter.

The annular rotor 15 is therefore mounted between the shank 12 and the rotor support 18'.

Also in this case the tubular rotor support 18' is housed internally to the shank 12 resting against the inner rest surface 12*f*, and is itself hollow similarly to the first embodiment to house therein the drive spring 14 and the central shaft 13*a* of the cover 13 (or the central shaft 211 of the plug 201, in the embodiment in which the device 10 does not comprise the cover 13). Furthermore, also in this case, the rotor support 18' has a lower surface 18'*d* inside said hollow tubular rotor support 18' which surrounds a lower opening 18*b* through which the central shaft 13*a* is free to slide. The lower surface 18'*d*, otherwise, acts as a striker against which the drive spring 14 acts.

Figure 18A:
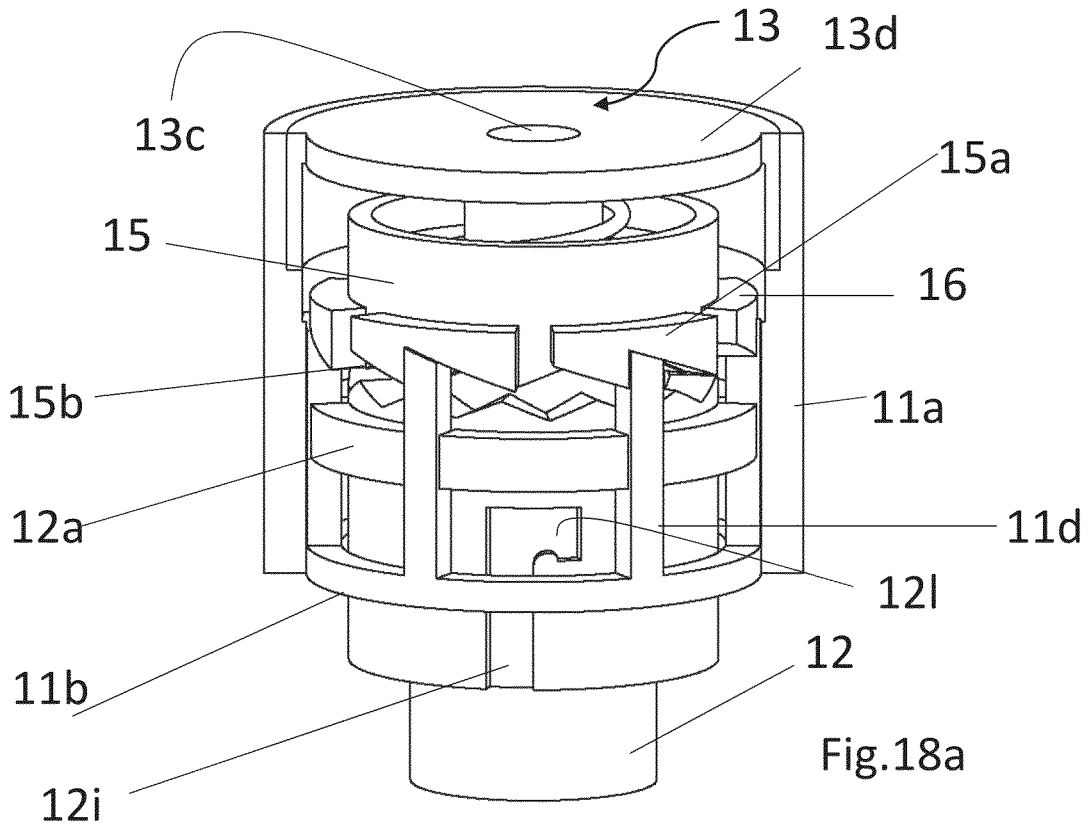
FIGS. 18*a* and 18*b* are partially split perspective views of the closing and opening device of FIG. 16, respectively in the closed and open positions.
Figure 18B:
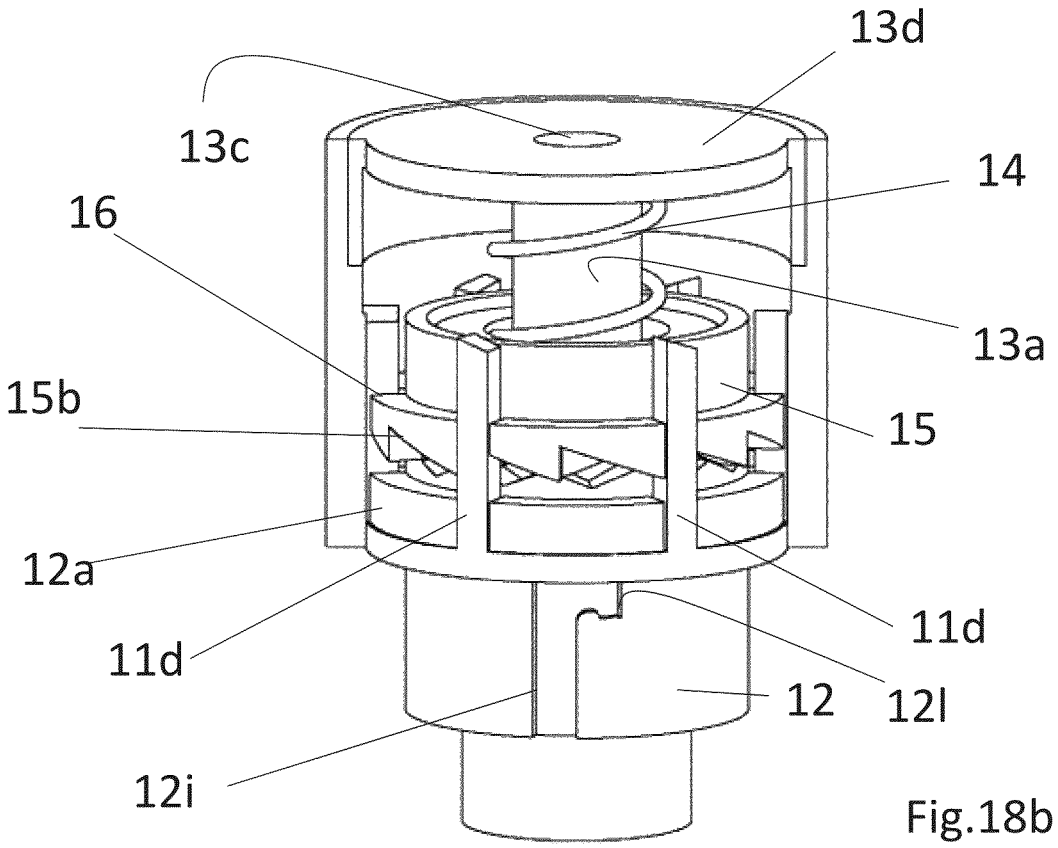

FIGS. 18*a*-18*b* show two positions that the opening and closing device 10 according to the second embodiment can assume: a first balanced position or closed position (FIG. 18*a*) and a second balanced position or open position (FIG. 18*b*).

Figure 17A:
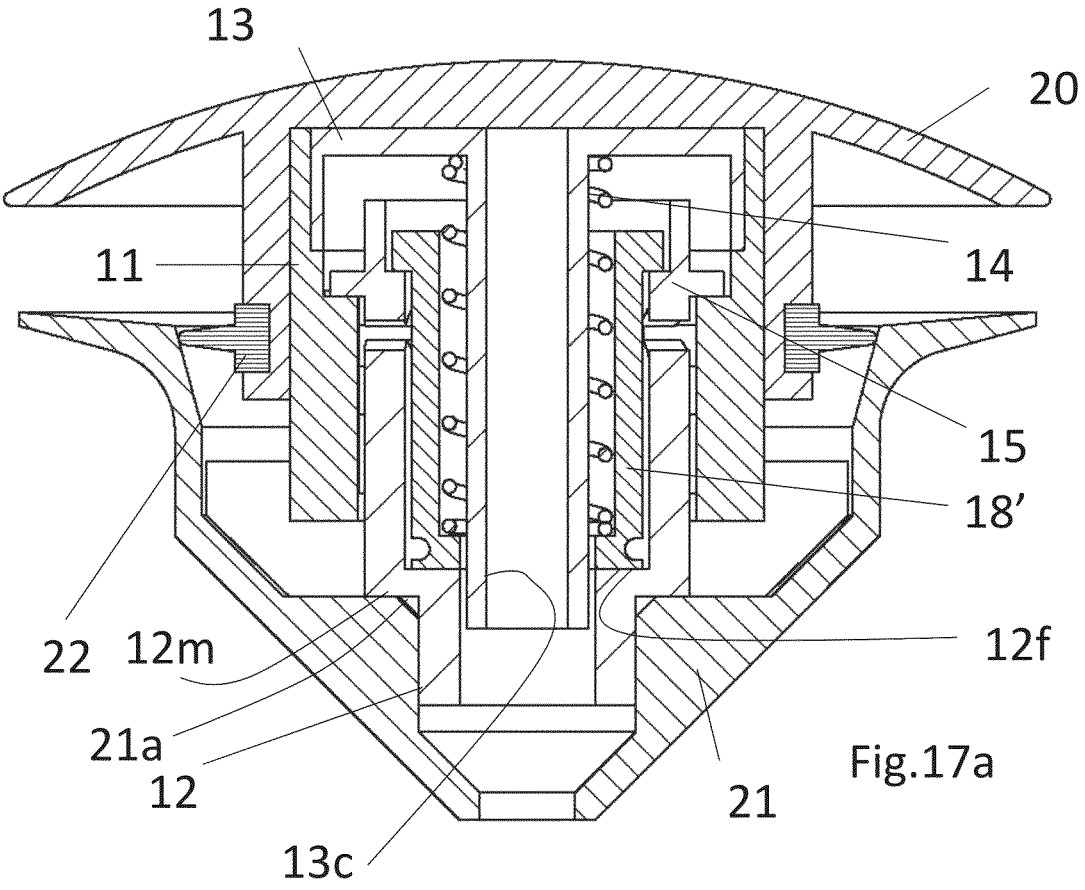
FIGS. 17*a* and 17*b* are sectional views of the closing and opening device of FIG. 16 in association with a plug and with an outlet of a sanitary fixture, respectively in the closed and open position.
Figure 17B:
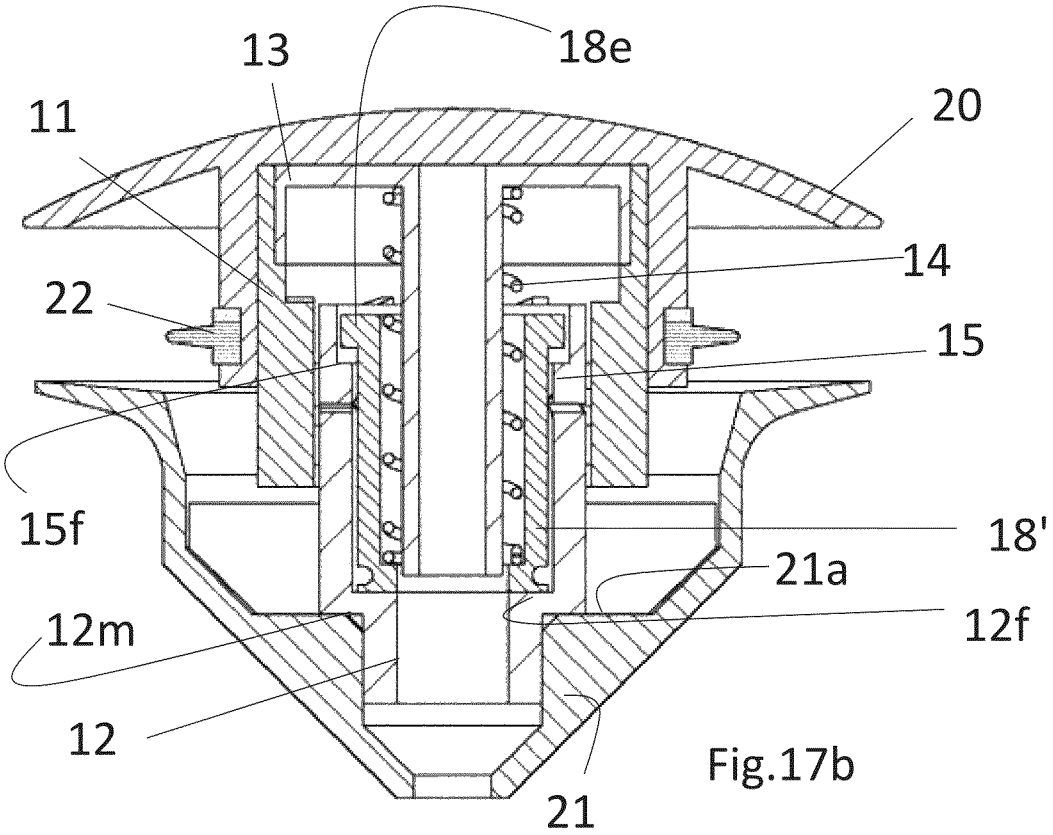

FIG. 18*a* shows the closed position of the device 10. In this position, the ribs 11*d* of the inner wall of the body 11 are in abutment against the first shaped surface 15*b* of the annular rotor 15 and, in particular, are housed in respective stop seats 15*d* defined by said first surface 15*b*. In this way, the sliding of the body 11 along the axis A is prevented by the striking action that the thrust elements 15*a* exert on the ribs 11*d*. In this closed position, the drive spring 14 cannot therefore push the plug 20 to rise. The plug itself is therefore arranged on the outlet 21 so as to compress the gasket 22 and make a hydraulic seal, as shown in FIG. 17*a*, preventing the outflow of water through the outlet 21 itself.

FIGS. 19*a*-19*l* illustrate the different steps with the relative positions of the elements that make up the device 10 in the passage from the open condition of the drain to the closed condition and vice versa, for this second embodiment.

When the device 10 is in the open condition of the drain, the ribs 11*d* are engaged in the respective seats 15*c* of the annular rotor 15 (FIG. 19*a*): the body 11 is free to slide under the action of the drive spring 14 and to rise with respect to the shank 12 to reach the open position in which the gasket 22 is arranged away from the outlet 21 and the outflow of water through the outlet 21 is not hindered.

Figures 19A, 19B, 19C, 19D, 19E, 19F, 19G, 19H, 19I, 19L:
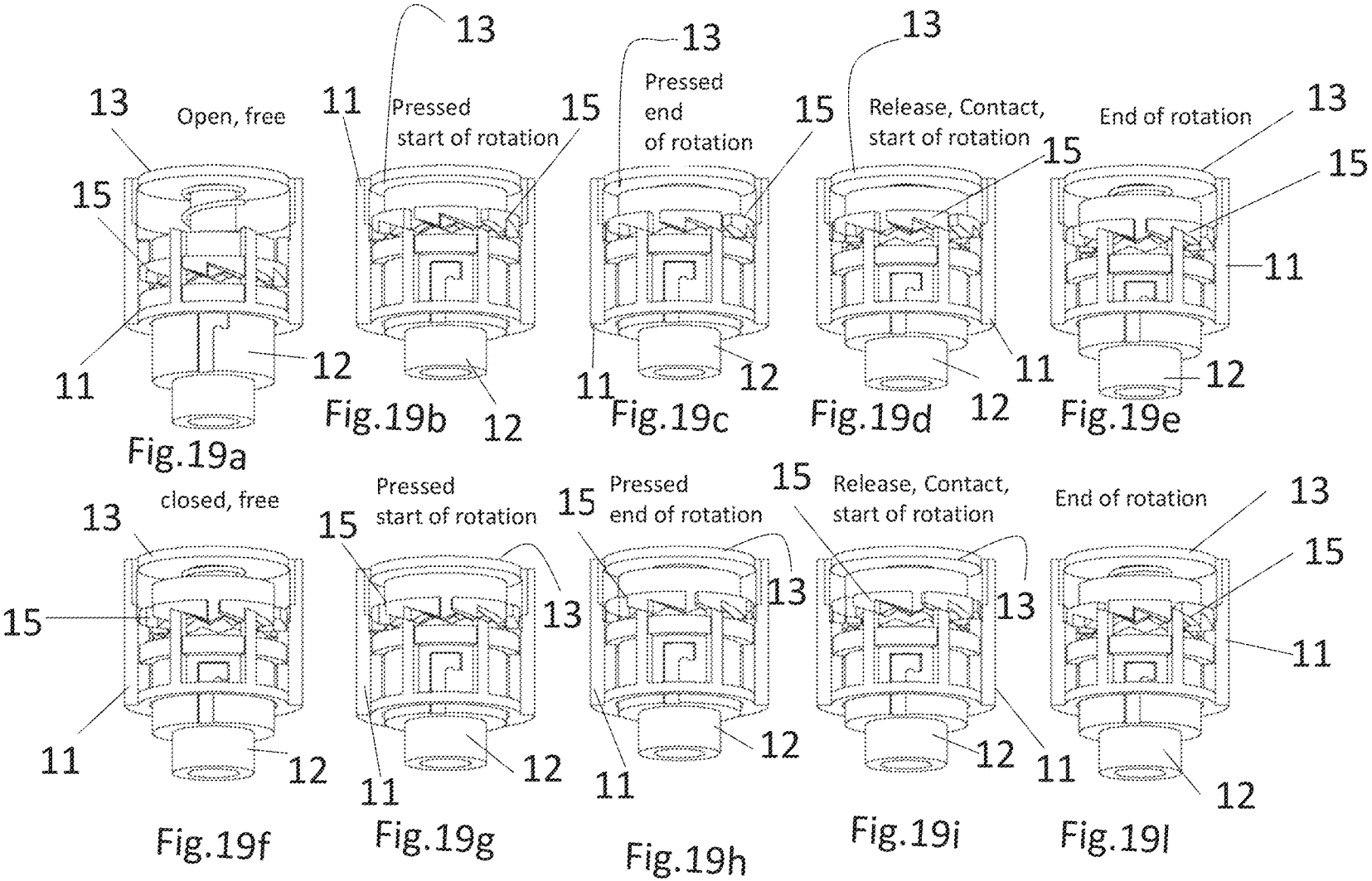
Figure 20:
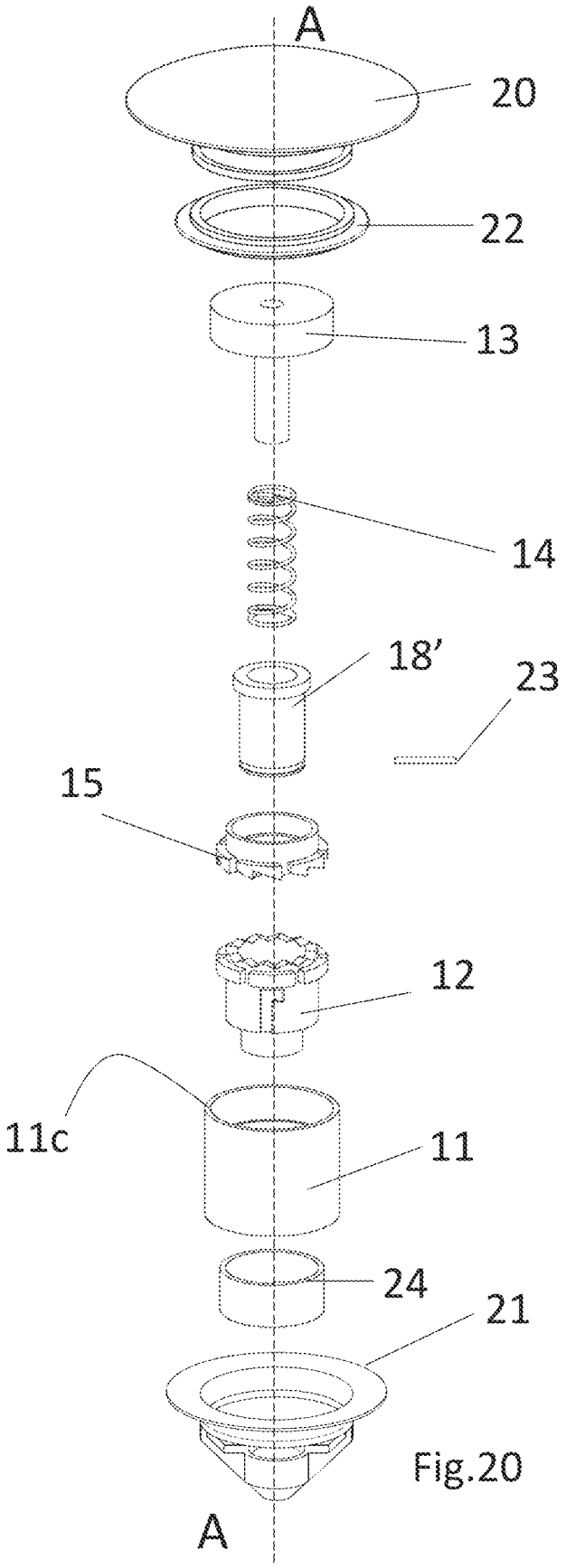
FIG. 20 is an exploded perspective view of another closing and opening device according to the present invention in association with a plug and with an outlet of a sanitary fixture.
Figure 21:
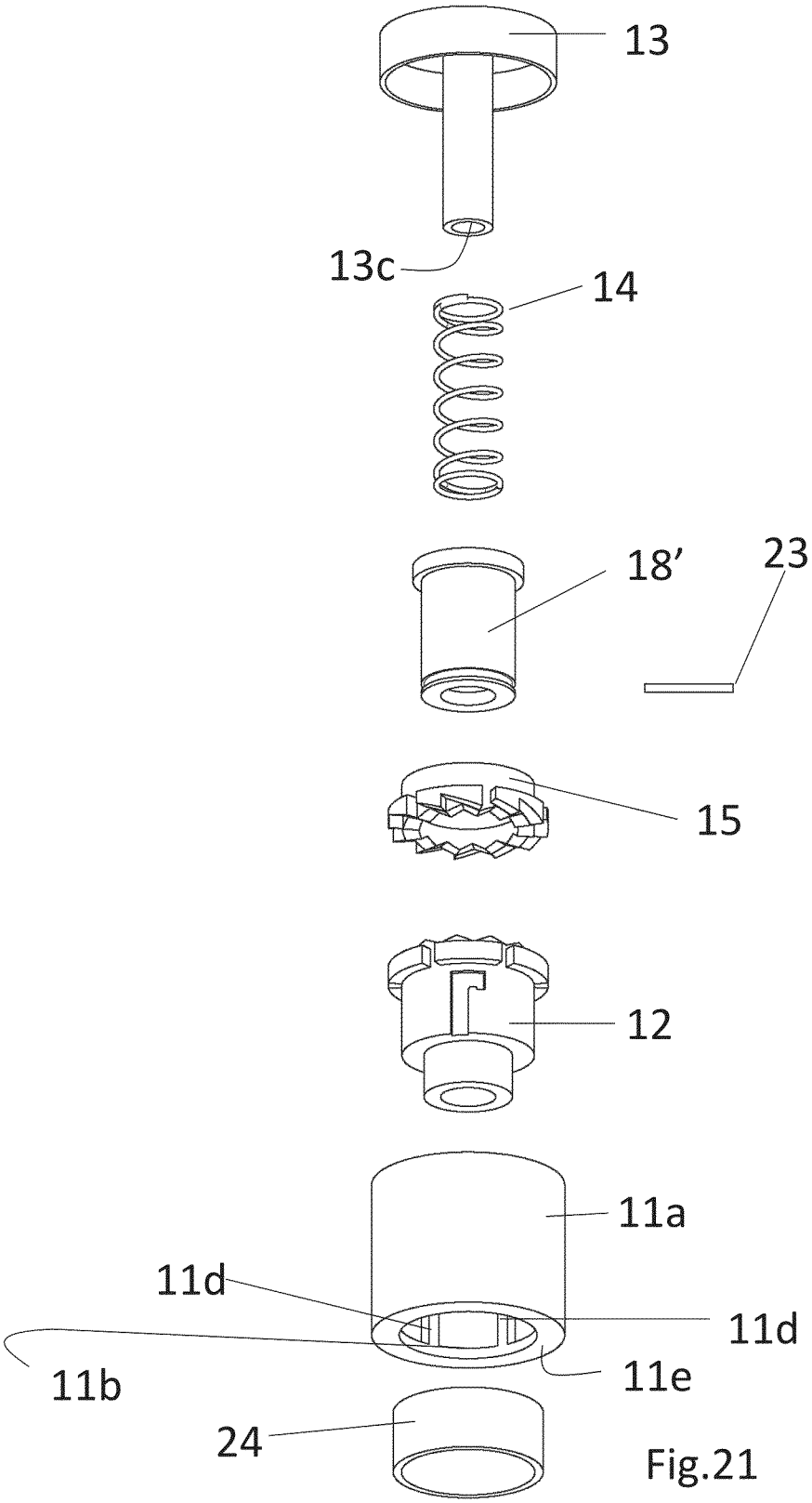
FIG. 21 is an exploded perspective view of the set of usable components in the closing and opening device of FIG. 20.

By acting on the body 11 with a pressure along the axis A approaching the rotor 15 to the shank 12, the second shaped surface 15*e* of the annular rotor 15 comes into engagement with the striking surface 12*g* made of the shank 12, as shown in FIG. 19*c* (in which it is shown the position of maximum momentary insertion of the shank 12 into the housing body 11). This causes a first disengagement of the ribs 11*d* from the respective sliding seats 15*c*, as the ribs 11*d* are initially moved downwards towards the shank 12.

In this way, a relative slipping of the two surfaces 12*g* and 15*e* along the respective shapes is allowed, which leads to a relative rotation between the annular rotor 15 and the shank 12 and, consequently, also between the annular rotor 15 and the body 11.

In this way, as illustrated in FIG. 19*d*, the end portion of the ribs moves at the inclined surface 15*b*" and the ribs 11*d* are gradually brought at the stop seats 15*d* and the opening and closing device 10 reaches its closed position (FIG. 19*f*).

According to this second embodiment, by pressing the body 11 by acting on the plug 201 or on the plug 20 and cover 13, the ribs 11*d* come out of the slots 15*c*, allowing the rotation of the annular rotor 15.

The spring transmits its force through the rotor support 18' on the shank 12, the rotation of the annular rotor 15 is generated by the force of gravity of the rotor, following the "descending" surface portion of the shank 12 provided on said surface 12*g* of the shank 12.

Conversely, to pass from the closed position to the open position, the user exerts pressure on the body 11 through the plug 201 or through the plug 20 with the cover 13, pushing the body 11 towards the shank 12. The ribs 11*d* move away and free themselves from the seats 15*d*.

A further translation of the body 11 towards the shank 12 causes the engagement between the second shaped surface 15*e* and the striking surface 12*g* (position of maximum momentary insertion of the shank 12 into the housing body 11) which causes a relative rotation between the rotor 15 and the shank 12 until the ribs 11*d*, by sliding on the inclined surface 15*b*'", are positioned again in the seats 15*c* (FIG. 19*l*).

It should also be noted that, also with reference to the second embodiment, it is possible to open the plug 20 simply by lifting it when the opening and closing device 10 is in the closed position illustrated in FIGS. 17*a* and 18'*a*. In fact, also in this case the rotor support 18 is free to slide with respect to the shank 12.

In essence, through the opening and closing device 10 according to the second embodiment it is possible to realize a snap-free closure with gravitational seal, through a plurality of components in common with the previously described embodiment. In particular, it is possible to make use of the same housing body 11, the same annular rotor 15 and the same shank 12, which is generally the most critical component with reference to the production of the opening and closing devices 10.

FIGS. 20-23 illustrate a third embodiment by means of which it is possible to realize a snap-free closure with a seal caused by a fixed position, i.e. in which the shank 12 and the rotor support 18' are stably associated with each other, allowing only free rotation. The rotor support 18' is limited in the axial movement with respect to the shank 12 by a blocking system 23. The rotor support 18' and the shank 12 are axially integral.

The rotor support 18', as described for the second embodiment, is inserted in the shank 12 and the coupling between the rotor support 18' and the shank 12 takes place thanks to a pin 23 inserted in at least one through hole 12*h* provided on the tubular wall of the shank 12, in such a way as to protrude partially inside said shank 12, and insert into a peripheral annular groove 18'*f* provided on the mantle surface, i.e. on the outer surface of said rotor support 18'.

Said groove 18'*f* is provided at the lower opening 18'*b* of the rotor support 18'.

The through hole 12*h* is provided at the narrowing of the shank 12.

Said pin 23, positioned transversely to the longitudinal axis of the rotor support 18', is housed at least partially in said groove 18'*f*.

Considering the device 10 mounted in a condition of use, said pin 23 is therefore positioned transversely to the drive axis A.

Figure 22:
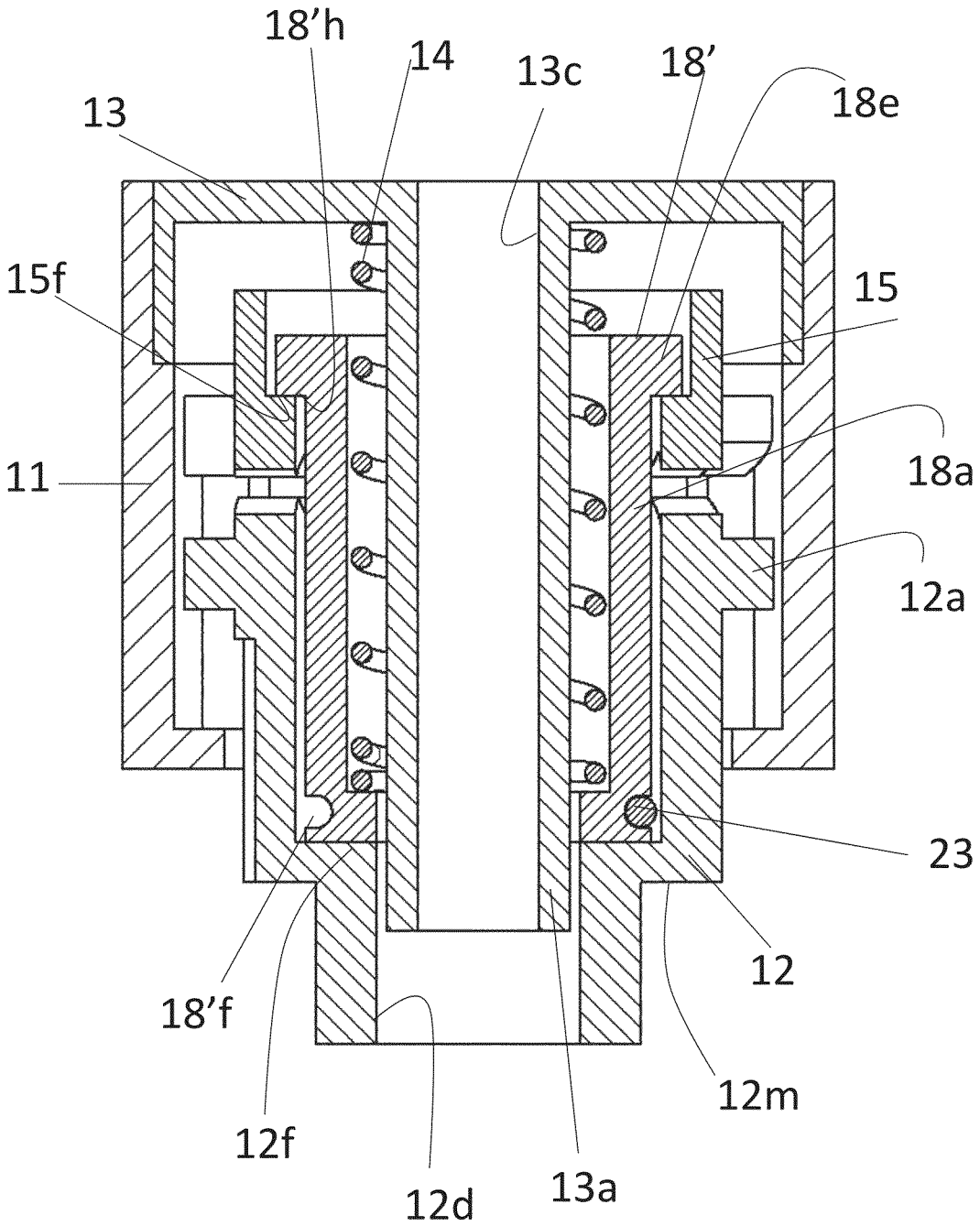
FIG. 22 is a sectional view of the closing and opening device of FIGS. 20 and 21 in the closed position.
Figure 23:
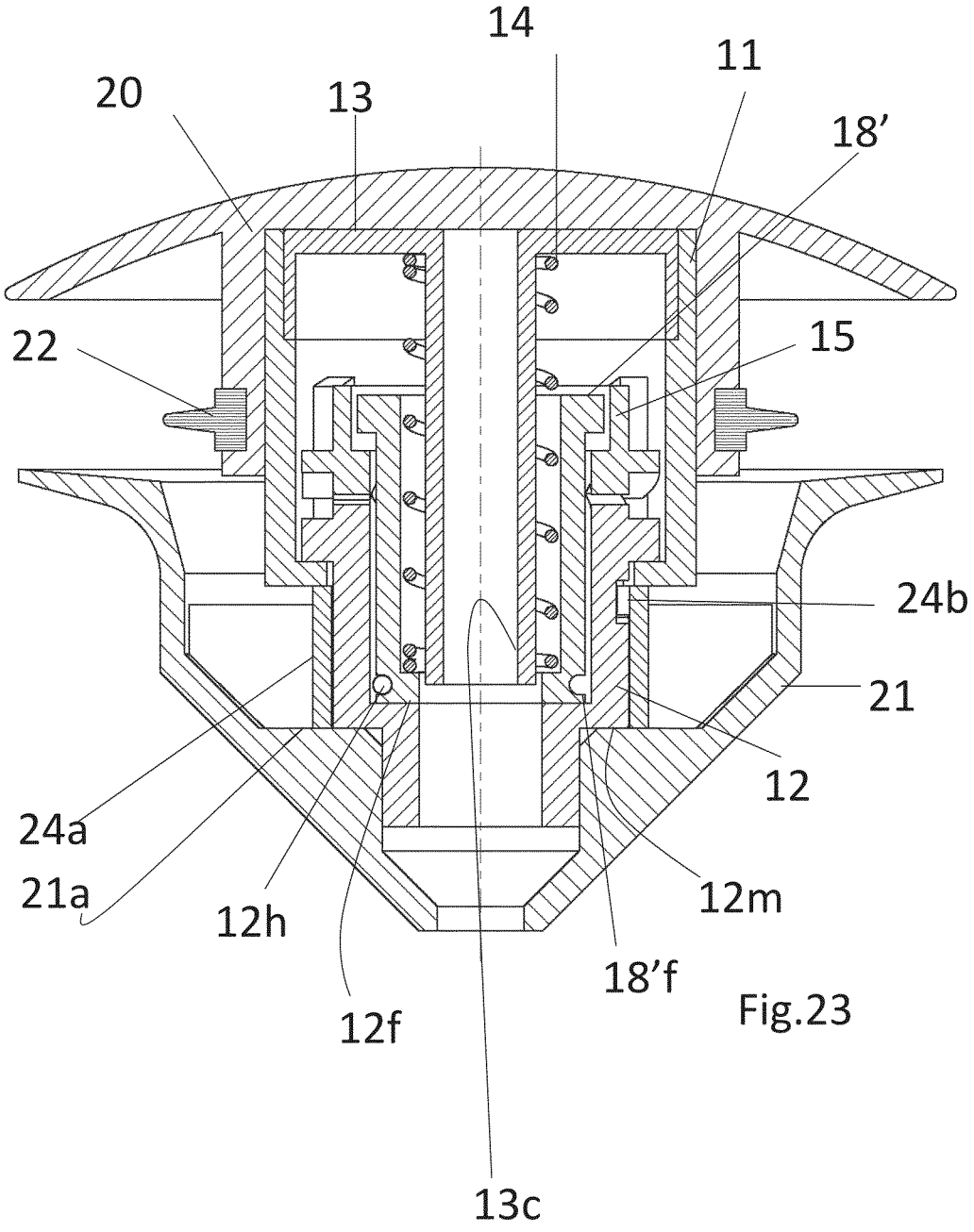
FIG. 23 is a sectional view of a closing and opening device according to the present invention associated with an outlet and with a plug blocked in the open position by the presence of the blocking means.

As illustrated in FIG. 22, when the device 10 is at least partially mounted, i.e. when at least the rotor support 18' coupled with the rotor 15, is inserted inside the shank 12, resting against the inner rest surface 12*f*, the pin 23 is inserted in the through hole 12*h* and is positioned in an arched portion of the groove 18'*f*, in such a way as to stably couple said rotor support 18' and said shank 12.

In this embodiment the annular rotor 15 is mounted on the rotor support 18' between the collar 18'*e* and the crown 12*a* of the shank 12 and is maintained in said position, with a limited axial movement along the axis A, by the insertion of the pin 23 in the through hole 12*h* and in the groove 18'*f*, which pin 23 stably blocks the shank 12 and the rotor support 18' together.

As illustrated in FIG. 22, the drive spring 14 and the central shaft 13*a* of the cover 13 (or the central shaft 211 of the plug 201) are housed in the hollow tubular body of the rotor support 18' in turn housed and stably associated with the shank 12.

In particular, as for the second embodiment described above, the rotor support 18' is in abutment with its end or base 18'*g*, opposite the collar 18'*e*, against the inner rest surface 12*f* of the shank 12 and the drive spring 14 acts against a lower surface 18'*d* of the rotor support 18' that surrounds the lower opening 18'*b* which in turn is in abutment against the inner rest surface 12*f* of the shank 12.

The central shaft 13*a* or the central shaft 211 of the plug 201 is free to slide in the cavity of the shank 12 until substantially reaching the lower opening 12*d* of the shank 12.

Also in this embodiment, the annual rotor 15 is made as described above: it has two concentric shaped lower surfaces, i.e. a radially outermost 15*b* and a radially innermost 15*e*.

In the closed position of the device 10 the ribs 11*d* of the inner wall of the body 11 are in abutment against the first shaped surface 15*b* of the annular rotor 15 and, in particular, are housed in respective stop seats 15*d* defined by said first surface 15*b*. In this way, the sliding of the body 11 along the axis A is prevented by the striking action that the thrust elements 15*a* exert on the ribs 11*d*. In this closed position, the drive spring 14 cannot therefore push the plug 20 to rise. The plug itself is therefore arranged on the outlet 21 so as to compress the gasket 22 and make a hydraulic seal, preventing the outflow of water through the outlet 21 itself.

By acting on the body 11 with a pressure along the axis A approaching the annular rotor 15 to the shank 12, the second shaped lower surface 15*e* of the annular rotor 15 comes into engagement with the striking surface 12*g* made on the shank 12. This causes a first disengagement of the ribs 11*d* from the respective stop seats 15*d*, as the ribs 11*d* are initially moved downwards towards the shank 12. In this way, a relative slipping of the two surfaces 15*e* and 12*g* along the respective shapes is allowed, which leads to a relative rotation between the annular rotor 15 and the shank 12 associated with the support 18' and, consequently, also between the annular rotor 15 and the body 11. In this way, the ribs 11*d* are gradually brought at the sliding seats 15*c*.

Once the ribs 11*d* engage the sliding seats 15*c*, the body 11 is free to slide under the action of the drive spring 14 and to rise with respect to the shank 12 to reach the open position. In this position, the gasket 22 is arranged away from the outlet 21 and the outflow of water through the outlet 21 is not hindered.

Conversely, to pass from the open position to the closed position, the user exerts a pressure on the body 11 through the plug 201 or through the plug 20 provided in combination with the cover 13, pushing the body 11 towards the shank 12. The ribs 11*d* thus slide within the sliding seats 15*c* until they free them. A further translation of the body 11 towards the shank 12 causes the engagement between the second shaped surface 15*e* and the striking surface 12*g* (position of maximum momentary insertion of the shank 12 into the housing body 11) which causes a relative rotation between the annular rotor 15 and the shank 12 until the ribs 11*d* engage the shaped surface 15*b* made below the thrust elements 15*a* of the annular rotor 15. This engagement causes a relative rotation between the annular rotor 15 and the body 11 until the ribs 11*d*, sliding along said shaped surface 15*b*, reach the respective stop seat 15*d* and the opening and closing device 10 reaches its closed position.

In practice, through the opening and closing device 10 according to the third embodiment, it is possible to achieve a snap-free closure with a seal from a stable position, that is, a fixed position of the rotor support 18' and shank 12, through components common to the previous embodiments and the addition of a pin 23, in particular, through the coupling between the rotor support 18' and the shank 12 thanks to said pin 23.

In this third embodiment the seal in the closed position (FIG. 22) is caused by the force of the spring 14. The body 11 cannot be lifted as the surfaces 11*d'* and the side surface of the rib 11*d* are in abutment against the surfaces 15*b*" and 15*d* of the annular rotor 15, the axial movement of the annular rotor 15 is limited (abutment surface 15*f* against the lower surface 18'*h* of the collar 18*e* of the rotor support 18), the rotor support 18' is fixed to the shank 12, so that the body 11 is in a position limited by the annular rotor 15-rotor support 18' combination and by the force of the spring 14. It is possible, therefore, by acting on the plug 20, to press towards the body 11, against the force of the spring 14, in order to be able to bring it into the open position but without it being able to rise.

Advantageously, the device 10 subject-matter of the present invention, in the three embodiments described above, can be provided with blocking means 24 that allow to keep the device 10 itself in an open condition (i.e. free drain). These blocking means 24 allow, while always keeping the device in an open and therefore open drain condition, to avoid the risk of flooding.

In the open position, as described above for the three embodiments, the drive spring 14 is substantially not compressed so as to bring the body 11 and therefore the plug 20 in a condition of maximum distancing from the shank 12 and from the outlet 21, with respect to the drive axis A. In this condition the gasket 22 is arranged away from the outlet 21 so that the outflow of water through the outlet 21 is not hindered.

Advantageously, in order to be able to have a device 10 always in the open condition as described above, the shank 12 described above for the three embodiments, on the outer surface 12*b* is provided with a slot 12*i* on the first cylindrical portion 12" of the shank 12 with a larger diameter, which slot 12*i* is provided on the outer surface (or mantle surface) of said first cylindrical portion 12".

The slot 12*i* extends on said outer surface 12*b* (or mantle surface) in a longitudinal direction towards the crown 12*a*, near which it folds to form a housing seat 12*l*.

As illustrated in the figures, therefore, said slot has a preferably L-like shape.

Said blocking means 24 comprise a bush 24*a* provided, on its inner mantle surface, with a shaped tooth 24*b* complementary to said housing seat 12*l*.

Said shaped tooth 24 b is provided near an opening 24*c* of said bush 24*a*.

The bush is fitted onto the shank 12.

The shaped tooth 24*b* is inserted into the slot 12*i*, sliding inside it until it is positioned in the housing 12*l*.

Preferably the insertion is snapped in such a way that no disengagement occurs during insertion into the outlet.

Figure 24:
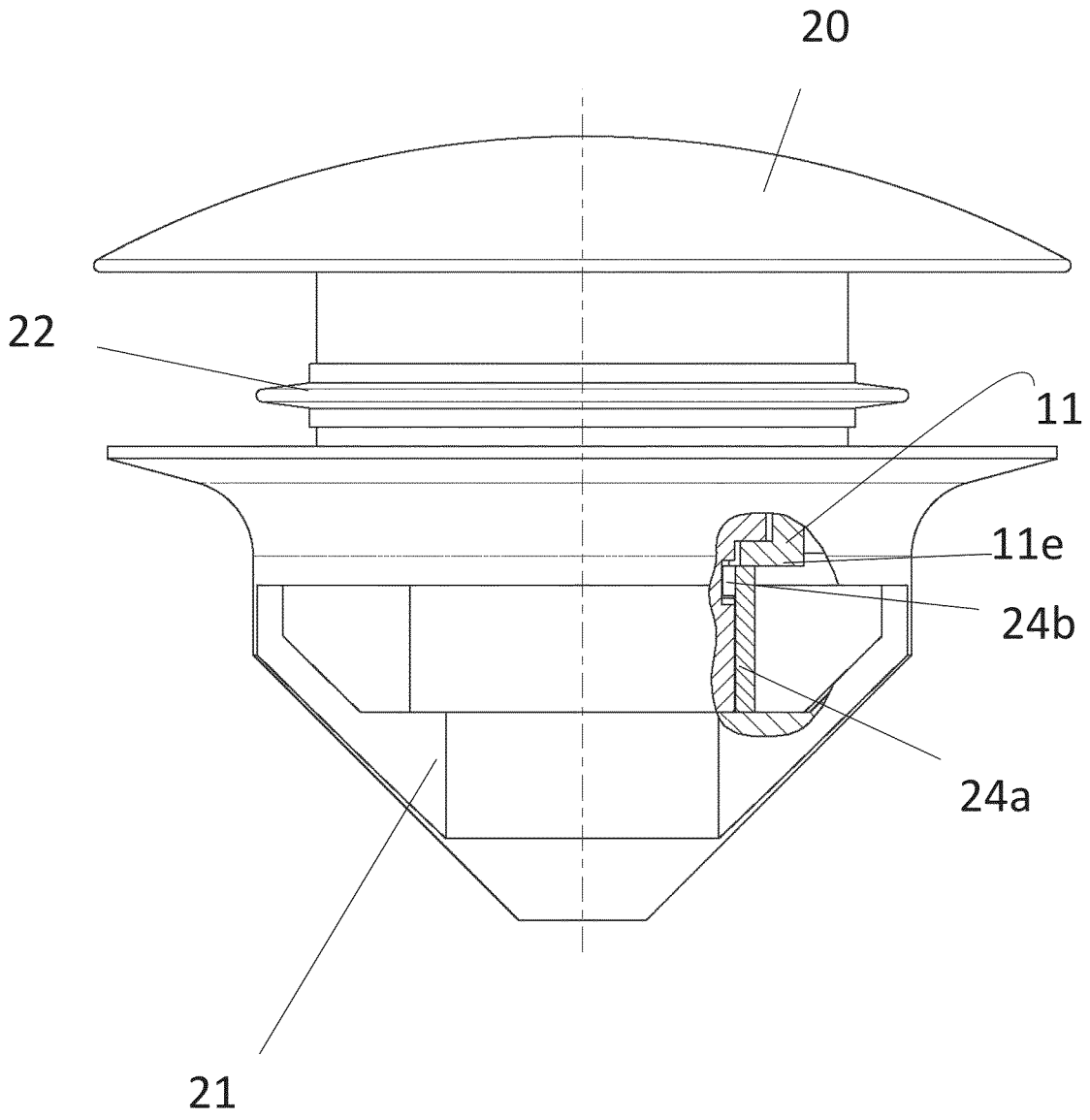
FIG. 24 is a view of a closing and opening device according to the present invention associated with an outlet and with a plug blocked in the open position, with a split view that exposes the blocking means.
Figure 25A:
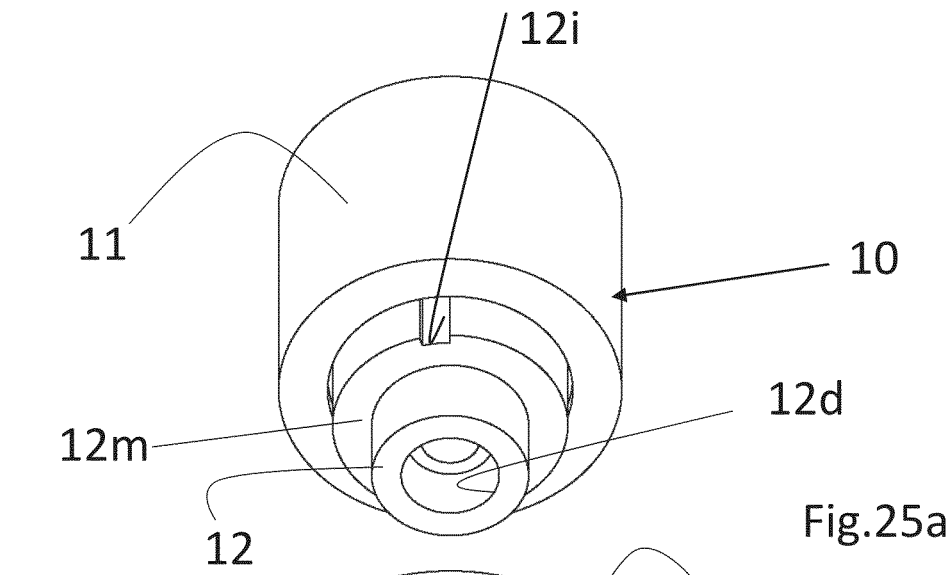
FIGS. 25*a*, 25*b* and 25*c* are different perspective views of a closing and opening device according to the present invention with assembled components.
Figure 25B:
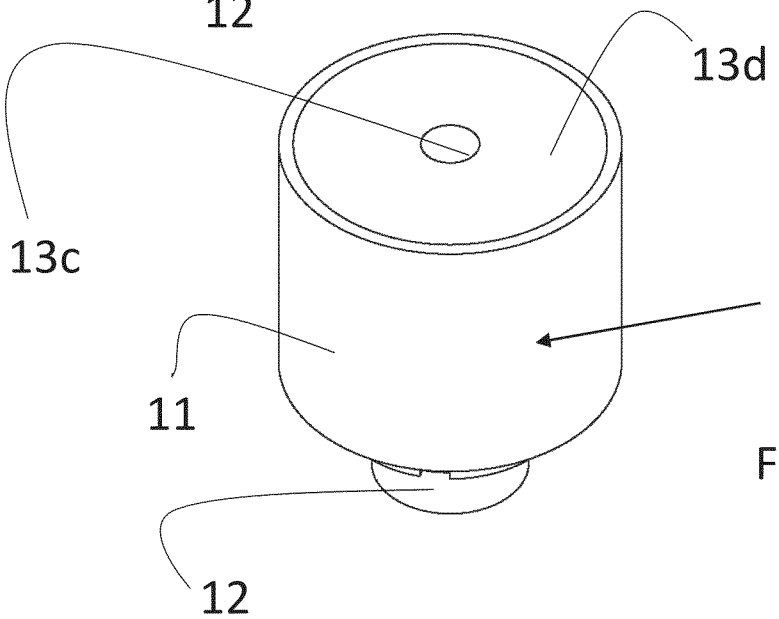
Figure 25C:
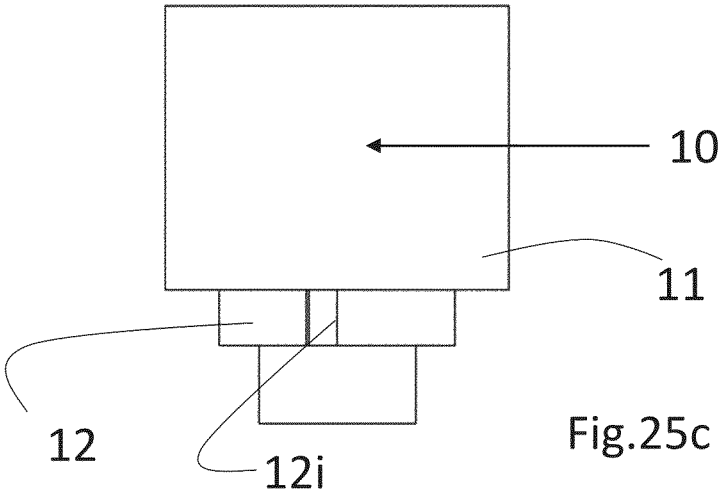

As illustrated in FIG. 24, the body 11 rests on the bush 24*a*: when said tooth 24*b* is positioned wedged in said housing 12*l*, the lower annular surface 11*e* of the body 11 is in abutment against the upper annular surface 24*d* of the bush 24*a*.

The presence of the bush 24*a* therefore prevents movement from the open to the closed position and vice versa keeping the device 10 in a stable open position.

The tooth 24*b* slides in the slot 12*i* are in the mounting/dismounting step of the bush on the shank 12, i.e. to be able to assemble or disassemble the bush 24*a* from the device 10 as described above.

To allow the device to be brought from an open position to a closed condition the bush 24*a* must be removed.

As it can be appreciated from what has been described, the opening and closing device 10 according to the invention has a versatile structure, easily adaptable in a plurality of different versions, each capable of offering its own peculiar feeling of use, while keeping almost all the components unaltered.

This makes it possible to exploit large-scale effects and optimise production procedures.

Obviously, the construction versatility is not at the expense of the reliability of the device 10, which guarantees optimal operation even after years of use, despite the fact that the device works in an unfavourable environment, as it is subject to water, dirt and limescale encrustations.

Reliability means that the device 10 does not get stuck or even stiff with use; moreover, under closed conditions the mechanism always guarantees the correct hermetic seal with the outlet.

Said device (also called pop-up device), able to be coupled to a plug and a drain, is advantageous because the push-button movement for activation by the user is simple and intuitive: the user simply has to press the pop-up plug, using for example your hand or foot, to alternate between the open and closed position.

The invention thus conceived is therefore susceptible of numerous modifications and variations and the above examples should not be interpreted in a limiting sense. Naturally, all the details can be replaced with other technically equivalent elements.

In practice, the materials used, as well as the contingent shapes and sizes, can be whatever according to the requirements without for this reason departing from the scope of protection of the following claims.

The invention claimed is:

1. A device for closing and opening by manual pressure a drain of a sanitary fixture, comprising:

a hollow tubular housing body configured to be integrally associated with a closing plug; and a shank at least partially housed inside the housing body, the shank being configured to be integrally connected to a drain outlet configured to be occluded by the closing plug, wherein the housing body comprises a tubular wall delimited at a first end by a lower opening and at a second end, opposite to the first end, by an upper opening, wherein the shank engages the lower opening, and the upper opening is at least partially engageable by the closing plug, wherein the tubular wall of the housing body comprises a plurality of ribs that develop parallel to a drive axis, and the shank comprises a crown protruding radially outward from an outer surface thereof, the crown defining two or more slots designed in a complementary manner and arranged in positions corresponding to the plurality of ribs, such that each rib engages a slot to allow a relative translation of the housing body with respect to the shank along the drive axis, and wherein the housing body is translatable with respect to the shank between a first closed position, in which a larger portion of the shank is stably inserted into the housing body, and a second open position, in which a smaller portion of the shank is stably inserted into the housing body, passing through a position of maximum momentary insertion of the shank into the housing body;

a drive spring configured to urge the housing body toward the second open position; and an annular rotor rotatable about the drive axis and designed to define:

a first shaped lower surface configured to cooperate with the plurality of ribs to bring and maintain the housing body in the first closed position, a plurality of sliding seats each designed to allow a sliding of a rib therein so as to allow a relative translation of the housing body with respect to the shank; and a second shaped lower surface configured to cooperate with a striking surface when the housing body and the shank are in the position of maximum momentary insertion, the striking surface being defined on a surface of the shank facing toward the annular rotor so as to cause a rotation of the annular rotor with respect to the housing body.

2. The device according to claim 1, wherein the first shaped lower surface and the second shaped lower surface are concentric.

3. The device according to claim 1, wherein the annular rotor comprises a plurality of thrust elements protruding from a side surface thereof, the thrust elements defining the first shaped lower surface on a first surface of the thrust elements turned toward the lower opening of the housing body, and wherein the second shaped lower surface is defined on a surface portion of the annular rotor turned toward the lower opening of the housing body and has an annular development that is concentric and radially more internal with respect to the first shaped lower surface.

4. The device according to claim 1, further comprising a plug provided with a central shaft that develops along the drive axis internally to the shank, the central shaft acting as a guide for the drive spring.

5. The device according to claim 1, wherein the first shaped lower surface of the annular rotor defines a plurality of stop seats each configured to house a free end of a rib when the housing body is in the first closed position.

6. The device according to claim 1, wherein the shank is provided, on an outer surface thereof, with a slot that extends in a longitudinal direction, folding at one end thereof to form a housing seat for a tooth provided on an inner mantle surface of a locking bush of the device in an open position, the locking bush being mounted externally on the shank, so that when the tooth is positioned wedged in the housing seat, a lower annular surface of the housing body is in abutment against an upper annular surface of the locking bush.

7. The device according to claim 1, further comprising a hollow rotor support housed internally and coaxially to the shank and to the annular rotor.

8. The device according to claim 7, wherein the shank is hollow and has a tubular wall with a variable diameter that defines an outer surface and an inner cavity, the inner cavity having a narrowing that defines an inner annular surface and an outer annular rest surface against protruding inner surfaces of the drain outlet.

9. The device according to claim 7, further comprising a cover which at least partially engages the upper opening of the housing body, the cover comprising a central shaft that develops along the drive axis internally to the shank, the central shaft acting as a guide for the drive spring.

10. The device according to claim 9, wherein the central shaft is tubular and the cover with central shaft is provided with an axial through hole.

11. The device according to claim 9, wherein the hollow rotor support has a hollow tubular body delimited at a bottom by a lower opening and at a top by an upper opening, opposite the lower opening with reference to a direction identified by the drive axis, and is provided with a lower surface inside the hollow tubular body of the hollow rotor support that surrounds the lower opening on which the drive spring acts, the central shaft of the cover or the central shaft of the closing plug being sized so as to be able to slide through the lower opening of the rotor support.

12. The device according to claim 7, wherein the rotor support has a hollow tubular body delimited at a bottom by a lower opening and at a top by an upper opening, opposite to the lower opening with reference to a direction identified by the drive axis, and wherein at the upper opening there is provided a collar made as one piece with the hollow tubular body of the rotor support, the annular rotor being provided in an inside thereof with an element that forms an abutment surface for the collar of the rotor support housed internally and coaxially to the annular rotor.

13. The device according to claim 12, wherein the shank is hollow and has a tubular wall defining an outer surface and an inner cavity, at least one radially protruding element being provided inside the inner cavity and forming a rest surface for a lower end or base, opposite the collar, of the rotor support, the rotor support having a longitudinal extension such as to be in abutment abut against the at least one radially protruding element.

14. The device according to claim 13, wherein the rotor support has a longitudinal extension such that the lower end or base, opposite the collar, rests against an inner annular surface of the shank.

15. The device according to claim 13, wherein the shank is provided on the tubular wall thereof with a through hole that radially crosses the tubular wall, and wherein the rotor support is provided with a peripheral annular groove on an outer surface thereof, the rotor support and the shank being stably coupled to each other by a pin inserted through the through hole in the peripheral annular groove.

* * * * *